US010933452B1

(12) United States Patent
Scaringe et al.

(10) Patent No.: US 10,933,452 B1
(45) Date of Patent: Mar. 2, 2021

(54) SYSTEM AND METHOD FOR PREVENTING CONDENSATE DRAIN PAN FLOODING, DETECTING CONDENSATE WATER OVERFLOW AND SHUTTING OFF AN AIR CONDITIONER OR HEAT PUMP TO PREVENT FURTHER FLOODING

(71) Applicant: Mainstream Engineering Corporation, Rockledge, FL (US)

(72) Inventors: Robert P. Scaringe, Rockledge, FL (US); Andrew L. Carpenter, Rockledge, FL (US); Dana L. Elliott, Palm Bay, FL (US); Luke L. Falls, Orlando, FL (US); Janelle M. Messmer, Satellite Beach, FL (US); Mark W. Fitz, Rockledge, FL (US)

(73) Assignee: Mianstream Engineering Corporation, Rockledge, FL (US)

( * ) Notice: Subject to any disclaimer, the term of this patent is extended or adjusted under 35 U.S.C. 154(b) by 0 days.

(21) Appl. No.: 16/776,583

(22) Filed: Jan. 30, 2020

Related U.S. Application Data

(63) Continuation of application No. 15/946,804, filed on Apr. 6, 2018, now Pat. No. 10,610,907.

(51) Int. Cl.
*F25B 49/00* (2006.01)
*F25B 41/37* (2021.01)
(Continued)

(52) U.S. Cl.
CPC ..... *B08B 9/032* (2013.01); *F24F 13/222* (2013.01); *F25B 41/20* (2021.01); *F25B 41/37* (2021.01);
(Continued)

(58) Field of Classification Search
CPC ..... F24F 13/222; F24F 2013/228; F24F 2221/225
See application file for complete search history.

(56) References Cited

U.S. PATENT DOCUMENTS 4,787,212 A 11/1988 Hessey
4,937,559 A 6/1990 Meacham et al.
(Continued)

FOREIGN PATENT DOCUMENTS

WO WO2006105017 A2 10/2006

OTHER PUBLICATIONS

Diversitech (Duluth, Ga) described on its website (http://media.diversitech.com/doc/DOC00015.pdf).

*Primary Examiner* — Nelson J Nieves
(74) *Attorney, Agent, or Firm* — Michael W. O'Neill, Esq.

(57) ABSTRACT

An anti-clogging liquid dispersion system and method for an air conditioner or heat pump is disclosed. A tank holds an anti-clogging liquid. A pump or valve connected with the tank periodically supplies the liquid to a condensate drain pan or the outlet of an existing drain line located exteriorly of a structure. One or more sensors are provided to detect moisture, flooding and/or lack of condensate flow and, when so detected, a control circuit causes the liquid to be supplied to the condensate drain pan to prevent flooding of a condensate drain pan or to clear a clogged drain line of an air handler of the air conditioner or heat pump. An additional dose of the liquid can also be supplied at any time when an unacceptable amount of condensate moisture and/or a clogged drain line has been detected.

10 Claims, 14 Drawing Sheets

(51) Int. Cl.

| | |
|---|---|
| ***B08B 9/032*** | (2006.01) |
| ***F24F 13/22*** | (2006.01) |
| ***F25B 41/20*** | (2021.01) |
| *F25B 43/00* | (2006.01) |

(52) U.S. Cl.
CPC ..... *F25B 49/005* (2013.01); *F24F 2221/22* (2013.01); *F25B 43/003* (2013.01); *F25B 2500/04* (2013.01); *F25B 2500/19* (2013.01); *F25B 2700/02* (2013.01)

(56) References Cited

U.S. PATENT DOCUMENTS

| | | | | |
|---|---|---|---|---|
| 4,987,408 | A | 1/1991 | Barron | |
| 4,998,412 | A | 3/1991 | Bell | |
| 5,049,801 | A | 9/1991 | Potter | |
| 5,294,916 | A | 3/1994 | Bolton et al. | |
| 5,341,673 | A | 8/1994 | Burns et al. | |
| 5,428,347 | A | 6/1995 | Barron | |
| 5,445,178 | A | 8/1995 | Feuer | |
| 5,463,377 | A | 10/1995 | Kronberg | |
| 5,514,344 | A | 5/1996 | D'Agaro | |
| 5,522,229 | A | 6/1996 | Stuchlik, III | |
| 5,632,904 | A | 5/1997 | Samad et al. | |
| 5,755,105 | A | 5/1998 | Lacoste | |
| 5,859,536 | A | 1/1999 | Stockton | |
| 5,921,094 | A | 7/1999 | Bang et al. | |
| 6,041,611 | A | 3/2000 | Palmer | |
| 6,229,229 | B1 | 5/2001 | Sharp | |
| 6,303,039 | B1 | 10/2001 | Back et al. | |
| 6,487,867 | B1 | 12/2002 | Herren | |
| 6,698,215 | B2 | 3/2004 | Bush et al. | |
| 6,798,220 | B1 | 9/2004 | Flanigan et al. | |
| 6,892,907 | B2 | 5/2005 | Varney | |
| 6,895,770 | B1 | 5/2005 | Kaminski | |
| 6,904,789 | B2 | 6/2005 | Campbell et al. | |
| 7,049,969 | B2 | 5/2006 | Tamai | |
| 7,071,830 | B2 | 7/2006 | Sahlberg et al. | |
| 7,392,658 | B1 | 7/2008 | Hardy, III | |
| 7,640,759 | B2 | 1/2010 | Robinson | |
| 7,686,034 | B1 | 3/2010 | Coogle | |
| 7,740,025 | B2 | 6/2010 | Scaringe | |
| 7,857,004 | B2 | 12/2010 | Pearson | |
| 8,475,603 | B2 | 7/2013 | Kaiser | |
| 8,646,474 | B2 | 2/2014 | Pearson | |
| 8,840,729 | B1 | 9/2014 | Herren et al. | |
| 9,289,525 | B1 | 3/2016 | Mansor et al. | |
| 9,289,803 | B1 | 3/2016 | Parks | |
| 9,352,986 | B2 * | 5/2016 | Reinolds | F24F 13/22 |
| 9,719,951 | B1 | 8/2017 | Woodbury et al. | |
| 9,776,890 | B1 | 10/2017 | Patterson et al. | |
| 9,975,152 | B1 | 5/2018 | McClarren | |
| 2003/0056812 | A1 | 3/2003 | Baker et al. | |
| 2004/0250841 | A1 | 12/2004 | Kimbrough | |
| 2005/0138939 | A1 | 6/2005 | Spanger | |
| 2006/0137127 | A1 | 6/2006 | Field et al. | |
| 2007/0119503 | A1 | 5/2007 | Scaringe | |
| 2008/0053134 | A1 | 3/2008 | Sakashita et al. | |
| 2008/0149475 | A1 | 6/2008 | Yamamoto | |
| 2010/0012291 | A1 | 1/2010 | Sporie | |
| 2013/0239991 | A1 | 9/2013 | Denvir et al. | |
| 2014/0116530 | A1 | 5/2014 | Pearson | |
| 2015/0048034 | A1 | 2/2015 | Reinolds | |
| 2016/0138816 | A1 | 5/2016 | Flaxer | |
| 2018/0112889 | A1 | 4/2018 | Barker | |
| 2018/0238029 | A1 | 8/2018 | Kuhbier | |
| 2018/0304316 | A1 | 10/2018 | Khandjian | |

* cited by examiner

SYSTEM AND METHOD FOR PREVENTING CONDENSATE DRAIN PAN FLOODING, DETECTING CONDENSATE WATER OVERFLOW AND SHUTTING OFF AN AIR CONDITIONER OR HEAT PUMP TO PREVENT FURTHER FLOODING

CROSS-REFERENCE TO RELATED APPLICATIONS

This application is a continuation of U.S. patent application Ser. No. 15/946,804, filed Apr. 6, 2018, which is incorporated by reference in its entirety.

BACKGROUND AND SUMMARY OF THE INVENTION

The present invention relates to an improved system and method for preventing condensate drain pan flooding using a liquid biocide or other liquid line cleaning solution (also collectively to be considered as "clog-clearing liquid") dispersion to prevent clogging due to biological formation in either the condensate drain pan or the condensate drain line, and for detecting condensate water overflow and shutting the heat pump or air conditioner off to prevent further flooding in the event drain lines become plugged for any reason.

Biocide tablets or chemical line cleaning solution such as those discussed in U.S. Pat. No. 6,303,039 are commonly placed into a condensate drain pan or in a tablet dispenser. For example, U.S. Pat. No. 7,740,025 describes locating the tablets in the condensate drain line where they dissolve and prevent biological formation. Unfortunately, these tablets typically dissolve far too quickly, having been totally dissolved in hours or days but certainly not lasting weeks or months. Furthermore, even if the tables dissolve slowly over a period of months, the concentration of the biocide in the tablets typically will be too dilute to provide a desired biocide disinfection unless the biocide tablets when first used were impractically large. Another issue with biocide tablets is that they must be secured or weighted to prevent them from flowing into the flow path and restricting the condensate flow to the point of plugging the drain flow path.

Ideally a biocide or other line cleaning treatment, should last a minimum of the air conditioning season. An even better result would be a tablet that can last for a year, that is typically until the next annual AC check-up. It is also far better to locate the biocide treatment, such as a biocide tablet, in the condensate pan, rather than the condensate line because location of the biocide tablet in the pan allows both the pan and the lines to be treated for biological growth. Furthermore, biological growth in the pan means that potentially harmful biological allergens are continuously exposed to the conditioned air flowing in the house.

Although placing the biocide directly into the drain pan rather than the drain line is clearly preferred, a homeowner may not be willing or capable of unscrewing and opening a sheet metal panel of the air conditioner to place a tablet into the pan at some common interval, e.g. monthly.

It is well also known in the art to place a float switch in at least one of the condensate pan, the condensate drain line, the condensate overflow port, or a secondary containing pan and/or to place a moisture indicating switch in at least one of the condensate overflow port, secondary containing pan or the floor under the air handler of the air conditioner to assure that the air conditioner or the compressor of the air conditioner is deactivated should the condensate water back up and activate one of these types of alarm switches due to a failure of the condensate to properly drain. The float switch is typically a magnetic reed switch surrounded by a magnet in a float, configured so that once the liquid level rises the reed switch opens and the low-voltage circuit controlling the power to the entire air conditioner or the power to the compressor is opened. The moisture indicating switch is typically a form of electrical conductivity probe where electrically conductivity between electrodes indicates the presence of water across the probes, and then then low-voltage circuit is opened to deactivate the air conditioning system. Either way, these switches are used to stop the cooling action of the air conditioner and thereby prevent the formation of additional condensate as well as prevent any flooding or additional flooding. One such float switch is the "SAFE-T-Switch" (http://www.rectorseal.com/safe-t-switch-model-ss2/) manufactured by Rectorseal (Houston, Tex.).

There are some disadvantages to the use of such float switches. For example; biological growth sometimes impedes the switch's free movement so the float is restrained from floating and the unit is not shut off to prevent an overflow. The movement of the float which is necessary to open the switch occasionally exceeds the pan height or the float is improperly adjusted, with the result that the water overflows before the float rises sufficiently to turn the unit off. This is, of course, the reason why a secondary float switch is used and is mandatory in some jurisdictions.

A conductivity detecting circuit, referred to as a moisture or water indicating switch or water-detecting switch, has been employed in which the presence of water across two electrodes completes a circuit and shuts off the air conditioner or compressor. Although mounting of a float switch is typically more involved than that of such circuits, the challenge with the latter, however, is to provide a device that is as cost competitive as a conventional float switch.

A secondary float switch is sometimes located in a secondary pan under the air handler. This configuration can be impractical where the air handler flow direction is upwards from below, making it difficult to place a secondary pan in this air flow path to catch any overflow of water. In those cases, a moisture- or water-indicating sensor is commonly used. This type of sensor is activated by the presence of water and is typically located on the on the floor either below or adjacent to the air conditioner's air handler like the conductivity detecting circuit previously discussed. The moisture or water indicating sensor serves as a back-up technique to detect any condensate water that might be leaking out of the air conditioner. They are typically some form of a conductivity sensor surrounded by a wicking material to accumulate the water around the two electrodes of the conductivity sensor. One such water detecting switch is the Wet Switch® which is manufactured by Diversitech (Duluth, Ga.) described on its website (http://media.diversitech.com/doc/DOC00015.pdf) as a solid state device designed to detect the presence of condensate water overflow.

A first object of the present invention is to provide a low-cost way to dispense a periodic shock loading and/or an intermittent or continuous preventative dosage of a biocide or other liquid line cleaning solution into the vapor compression system, where the quantity of liquid cleaning solution being dispensed can be optionally adjusted when a blockage is detected.

A second object of the present invention is to provide a low-cost way to provide an accurate and controlled release of biocide or other liquid line cleaning solution into the vapor compression system.

A third another object of the present invention is to provide a method of releasing the biocide or other liquid line cleaning solution into the vapor compression system at a time when dilution of the cleaning solution by the condensate flow will be minimized, such as when the air conditioner's cooling operation is just beginning.

A fourth object of the present invention is to combine a high condensate alarm, secondary water overflow alarm and anti-clogging biocide or other liquid line cleaning solution dispersion into a single electronic device to reduce cost and simplify installation.

A fifth object of the present invention is to provide a system that will advantageously deliver the biocide directly by any route to the condensate pan such as through the main condensate drain line, the overflow drain line, or other simple ingress path to the condensate pan like a drilled hole. While our currently preferred approach is to deliver the biocide through the drain line, one skilled in the art with the benefit of our teachings would now understand that numerous piping connections could be used to route the flowing liquid condensate to the drain pan without significant or costly modifications to the air handler within the scope of our invention.

A sixth object of the present invention is to automatically prevent biological formation and protection, for extended periods of time without user intervention, thereby eliminating the need to repeatedly place any biocide or other liquid line cleaning solution product in the drain line, in an in-line dispenser, or directly in the condensate pan and without the need to remove any panels on the unit.

A seventh object of the present invention is to provide a variable and adjustable quantity dispersion method for the biocide or other liquid line cleaning solution chemical such that a lethal concentration is provided when needed as determined by the status of the overflow protection sensor, lower dosages are dispersed for preventative purposes and no biocide is dispersed at other times.

An eight object of the present invention is to integrate the liquid line cleaning solution dispersion with primary condensate overflow protection using a singular connection to the drain pain, using either the secondary overflow connection or the primary flow connection.

A ninth object of the present invention is to integrate secondary condensate overflow protection into the device using one of a sensor in the secondary overflow connection, in the secondary drain pan or on the floor surface below the air conditioner.

A tenth object of the present invention is to prevent false alarms of water overflow, such as condensate, from unnecessarily halting the cooling operation of the air conditioner or the humidifier.

An eleventh object of the present invention is to use the injection of the biocide or other liquid line cleaning solution, when an overflow condition is detected, in an effort to clear a clogged flow path. We have recognized that if both secondary and primary overflow are monitored separately and the primary overflow sensor has detected water, then in addition to stopping operation of the unit, the injection of clog clearing solution is continued for an additional dose of cleaner up to a maximum dosage which is determined by the detection of moisture at the secondary overflow sensor. Use of the secondary sensor to detect overflow will maximize the quantity of clog-clearing cleaner used and increase the likelihood of clearing any clog in the flow path while keeping the unit from producing additional condensate since the unit is off. With no additional condensate being generated, the biocide is not further diluted.

A twelfth object of the present invention is to monitor for the overflow of the air conditioner condensate drain system and/or the heating or humidifier system. The present invention allows any desired number of low-cost additional conductivity sensors to be placed in overflow locations of the heating and/or cooling systems, all wired in parallel, to shut off either humidification operation during heating season and/or cooling operation, and to dose additional biocide or other liquid line cleaning solution if water is detected.

A thirteenth object of the present invention is to prevent false alarms caused by moisture or water droplets bridging the moisture detecting electrodes, namely that condensate overflow is being detected at the sensor location. One method to achieve this object is to use more than two conductivity electrodes (wired in series or monitored separately), a second method is to provide a more tortuous path for the liquid water to reach one or more of the electrodes, and a third method is to exploit the differential pressure that exists between the drain pan and the interior of the home to flow air over one or more electrodes to prevent the accumulation of moisture on the electrodes that could result in false alarms.

BRIEF DESCRIPTION OF THE DRAWINGS

These and other objects, features and advantages of the present invention will become more apparent from the following detailed description thereof when taken in conjunction with the accompanying drawings wherein.

DETAILED DESCRIPTION OF THE DRAWINGS

Figure 1:
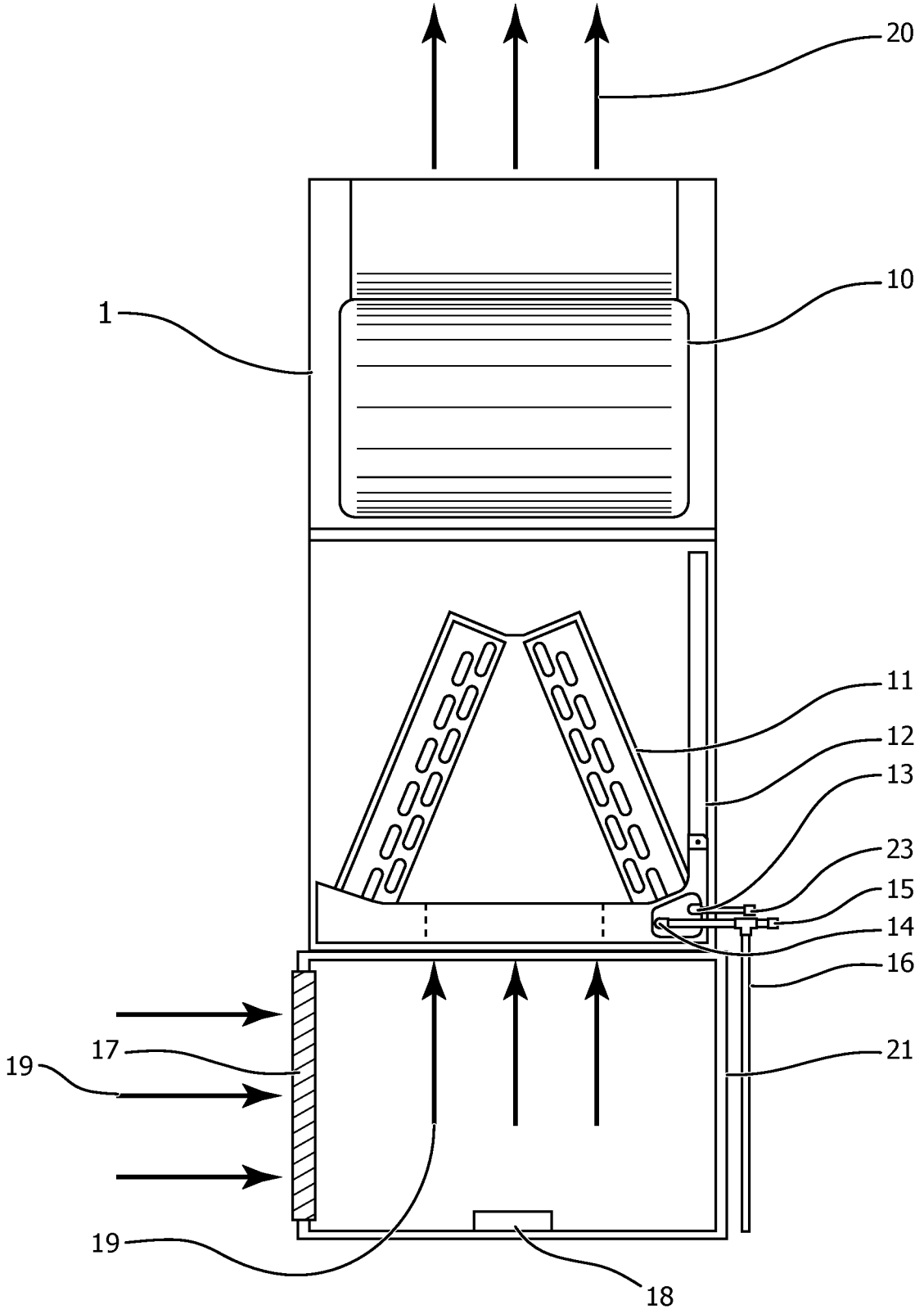
FIG. 1 is a schematic elevational view of a conventional air handler positioned for upward air flow.

Referring now to FIG. 1 a vertical air flow installation of a typical vapor compression system like an air conditioning or heat pump air handler 1 is shown that may, for example, be incorporated with a furnace or electrical heating system. The blower 10, A-style indoor coil 11, condensate drain pan 12, condensate outlet (for vertical or up-flow installation) 14, the secondary condensate outlet (for this vertical or up-flow installation shown) 13, primary condensate overflow switch 15, secondary optional floor moisture or water indicating sensor 18, condensate drain line 16, return airflow grill 17 as well as the direction of return air flow 19 and the direction of conditioned air flow 20 are all well known in the art. It will be understood, of course, that different units may have somewhat different configurations. The illustrated configuration is exemplary of known air conditioner and heat pump air handlers. It is also well known in the art to utilize a secondary float switch 23 instead of the floor switch 18 as the secondary or back up safety switch. To allow vertical air flow, this type of air handler can be located on a support structure 21 that is supported by the floor below.

Figure 2:
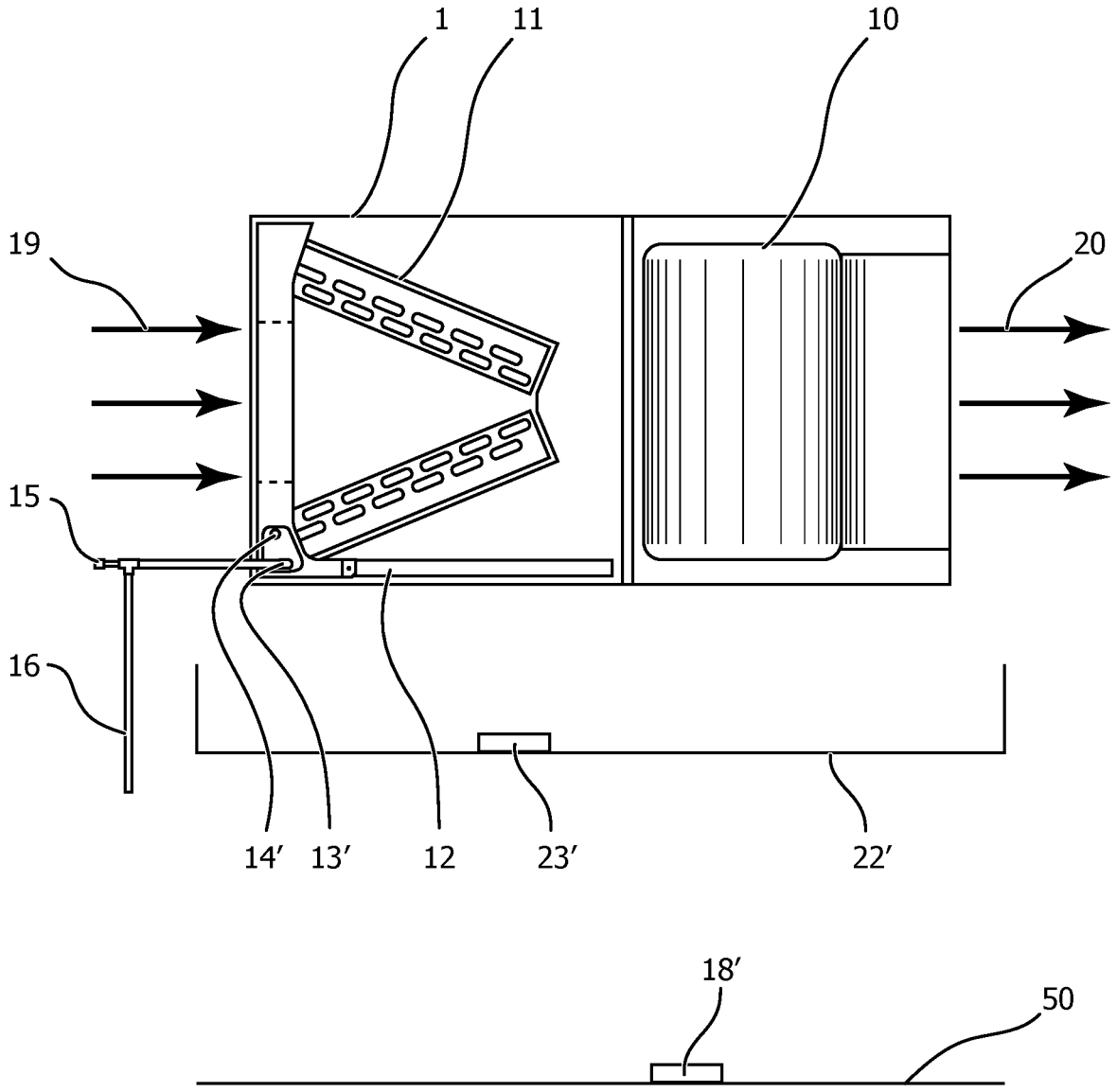
FIG. 2 is a schematic elevational view of a conventional air handler like that shown in FIG. 1 but positioned for horizontal air flow.

FIG. 2 shows a horizontal air flow installation of the same typical air conditioning or heat pump air handler shown in FIG. 1 in the vertical air flow installation. It to be understood that like FIG. 1, the air handler 1 need not be incorporated with a furnace or electrical heating system. Again, the blower 10, A-style coil 11, condensate drain pan 12, condensate outlet (for this horizontal air flow installation) 13', the unused condensate outlet (which for this horizontal air flow installation would be too high to be used and cause condensate to overflow the pan first) 14', primary condensate overflow switch 15, secondary drain pan overflow switch 23', condensate drain line 16 as well as the direction of return air flow 19 and the direction of conditioned air flow 20 are again all well known in the art while different units may have somewhat different configurations. The illustrated horizontal air flow configuration has been selected to exemplify known types of air conditioner and heat pump air handlers. It is also well known in the art to utilize a secondary moisture or water indicating sensor 18' on some surface 50 below the air handler that would indicate if the condensate overflowed instead of the secondary float switch or moisture indicating sensor 23' in the secondary drain pan 22', or as a third back-up safety switch. Alternatively, for drain pan configurations where the secondary condensate outlet would become wet before the pan overflowed, the secondary float switch or moisture or water indicating sensor can be located in the secondary condensate outlet 14' instead of being located in the overflow secondary overflow pan 22'. It is also worth noting that the primary condensate outlet 14 in the vertical airflow configuration in FIG. 1 is the secondary condensate outlet 14' of the horizontal airflow configuration in FIG. 2.

Figure 3:
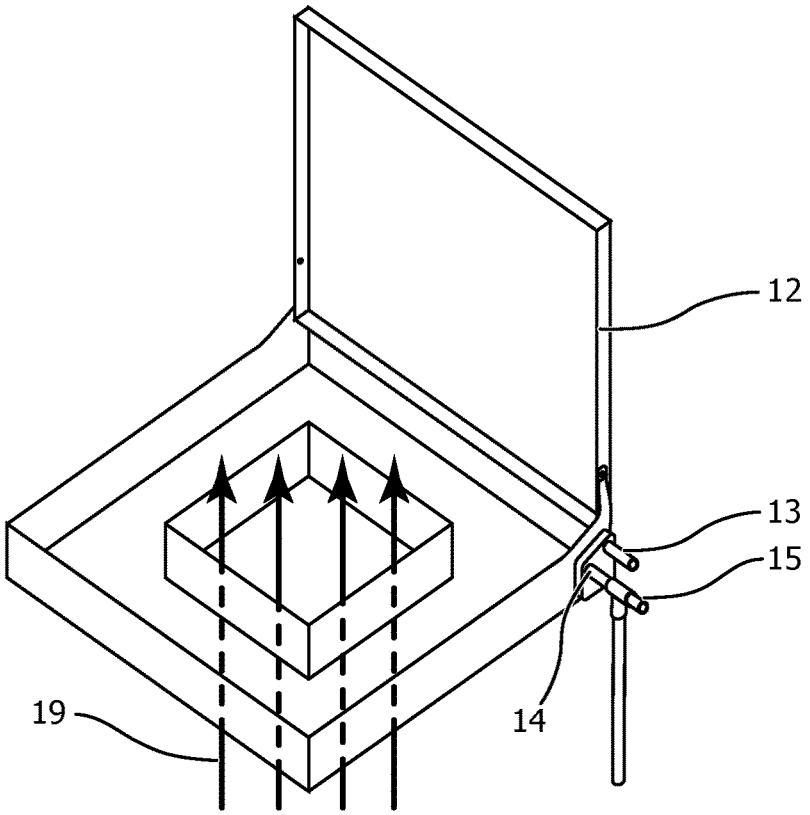
FIG. 3 is a perspective isolated view of the condensate drain pain used in the conventional air handler of FIG. 1 shown for the upward air flow configuration.

FIG. 3 schematically shows the condensate pan of the same typical air conditioning or heat pump air handler shown in FIG. 1 in the vertical air flow installation. The condensate drain pan 12, condensate outlet (for this vertical or up-flow installation shown) 14, the secondary condensate outlet (for this vertical or up-flow installation shown) 13 and primary condensate overflow switch 15, as well as the direction of return air flow 19 are all well known in the art while, again we note, different units may have somewhat different drain pan configurations.

Figure 4:
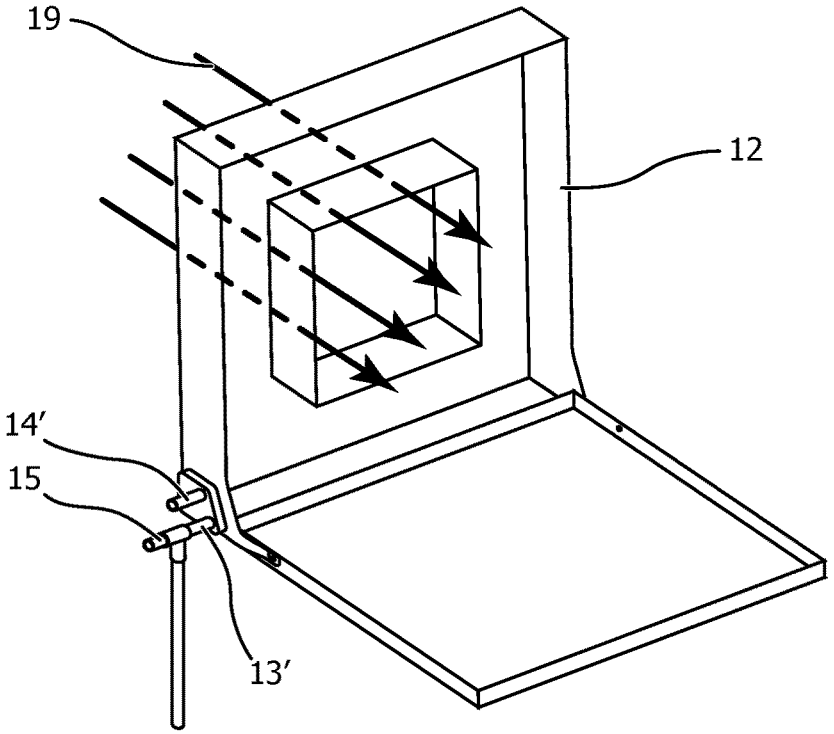
FIG. 4 is a perspective isolated view of the condensate drain pain used in the conventional air handler of FIG. 2 shown for the horizontal air flow configuration.

FIG. 4 schematically shows the condensate pan of the same typical air conditioning or heat pump air handler shown in FIG. 2 in the horizontal air flow installation. The condensate drain pan 12, condensate outlet (for this horizontal air flow installation shown) 13', the secondary condensate outlet 14' (note that, for this horizontal air flow installation, the secondary outlet is above the horizontal pan and therefore condensate would overflow the pan before flowing from this outlet in this configuration) and primary condensate overflow switch 15, as well as the direction of return air flow 19 are all well known in the art while different units may have somewhat different drain pan configurations.

Figure 5:
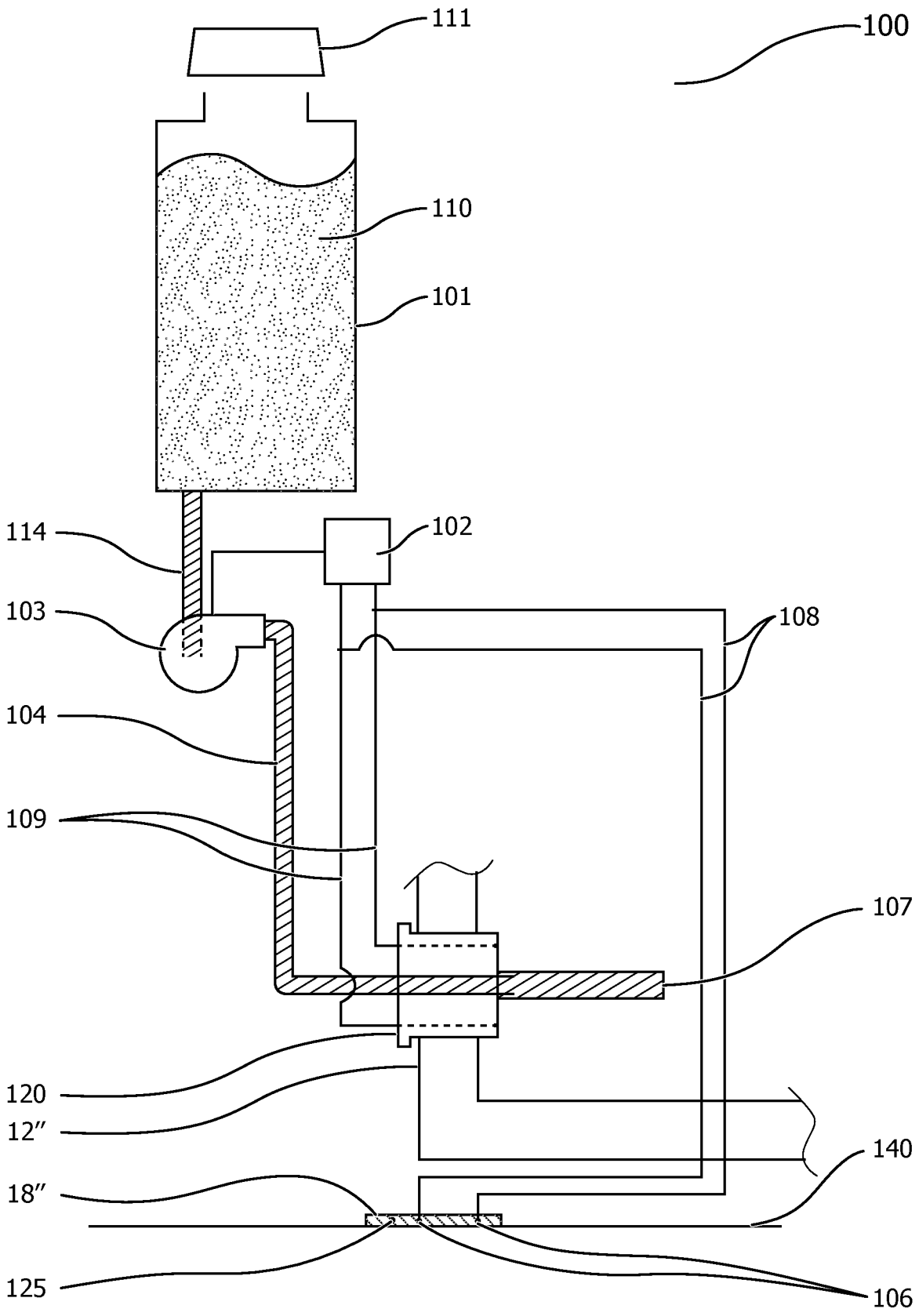
FIG. 5 is a schematic view of one currently preferred embodiment of the condensate drain pain system according to the present invention and using a pump to control the flow of biocide or other liquid line cleaning liquid.
Figure 8:
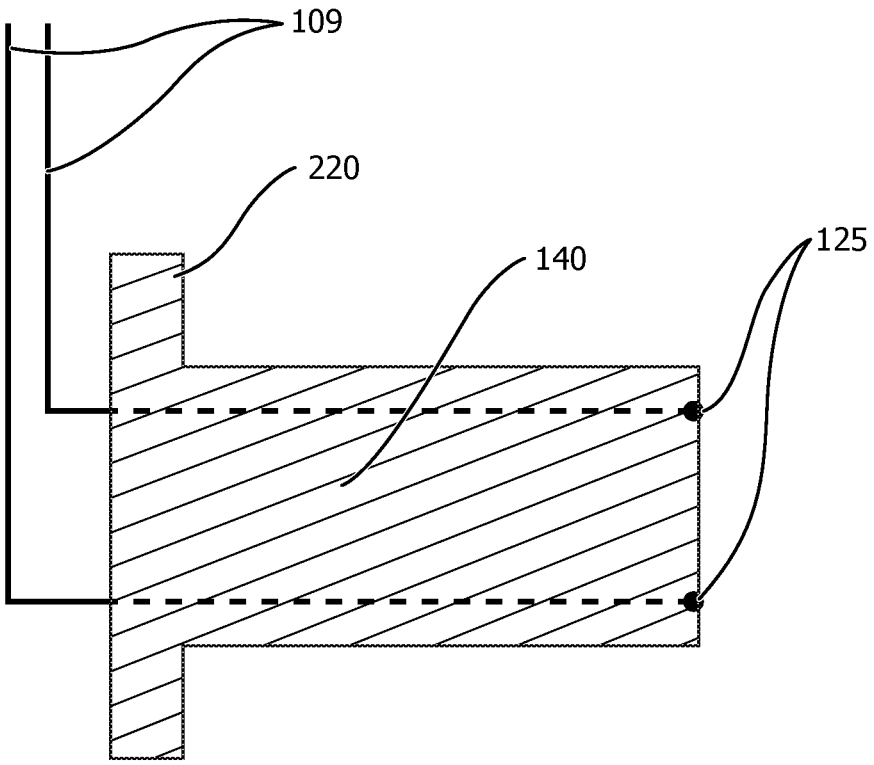
FIG. 8 is an isolated, schematic cross-sectional view of an alternative embodiment of moisture detecting sensor designed to be installed into a female plumbing fitting in a drain pan or overflow pan used with the present invention.

FIG. 5 schematically illustrates the main components of a currently preferred embodiment of the condensate drain protection system 100 according to the present invention. The system includes a biocide or other liquid line cleaning solution storage and dispensing tank 101 which is initially filled with a biocide or other liquid line cleaning solution liquid 110. A cap 111 is used for ease of filling the tank and to prevent spillage from the dispensing tank. The biocide or other liquid line cleaning solution 110 is dispensed into the condensate drain pan 12" of the air handler 1 shown in FIGS. 1 and 2 by a pump 103. An electronic circuit 102 controls the activation and timing of the pump 103. When the pump is activated by the control electronics 102, the biocide or other liquid line cleaning liquid 110 flows from the storage and dispensing tank 101 through a hose 114 leading to the inlet of the pump 103, then from the pump 103 through the hose 104 to the passage through a sensor and dispensing fitting 120 and then down a dispensing tube 107 from which the liquid falls into the condensate drain pan 12" inside the air handler 1. In other embodiments, as can be easily envisioned by one skilled in the art, the hose 104 may take any number of alternate ingress paths from the exterior of the air handler 1 into the condensate drain pan 12". Likewise, the sensor and dispensing fitting 120 is typically inserted into the primary overflow fitting locations such as 14 in FIG. 1 or 13' in FIG. 2. A secondary overflow sensor (as shown in FIG. 8 described below) is then used in the secondary overflow fitting or in an overflow pan under the unit, or a secondary moisture or water indicating sensor can be placed on the floor under the unit as shown in FIG. 1. However, one skilled in the art would understand that the primary and secondary sensors can be located in other locations to determine when the condensate drain pan is not flowing properly. Also, although an electrical continuity switch is being used in the currently preferred embodiment to detect the presence of water, it is understood that other ways can be used to detect the existence of excess water in the drain pan including the use of a float switch or optical switch.

Figure 5A:
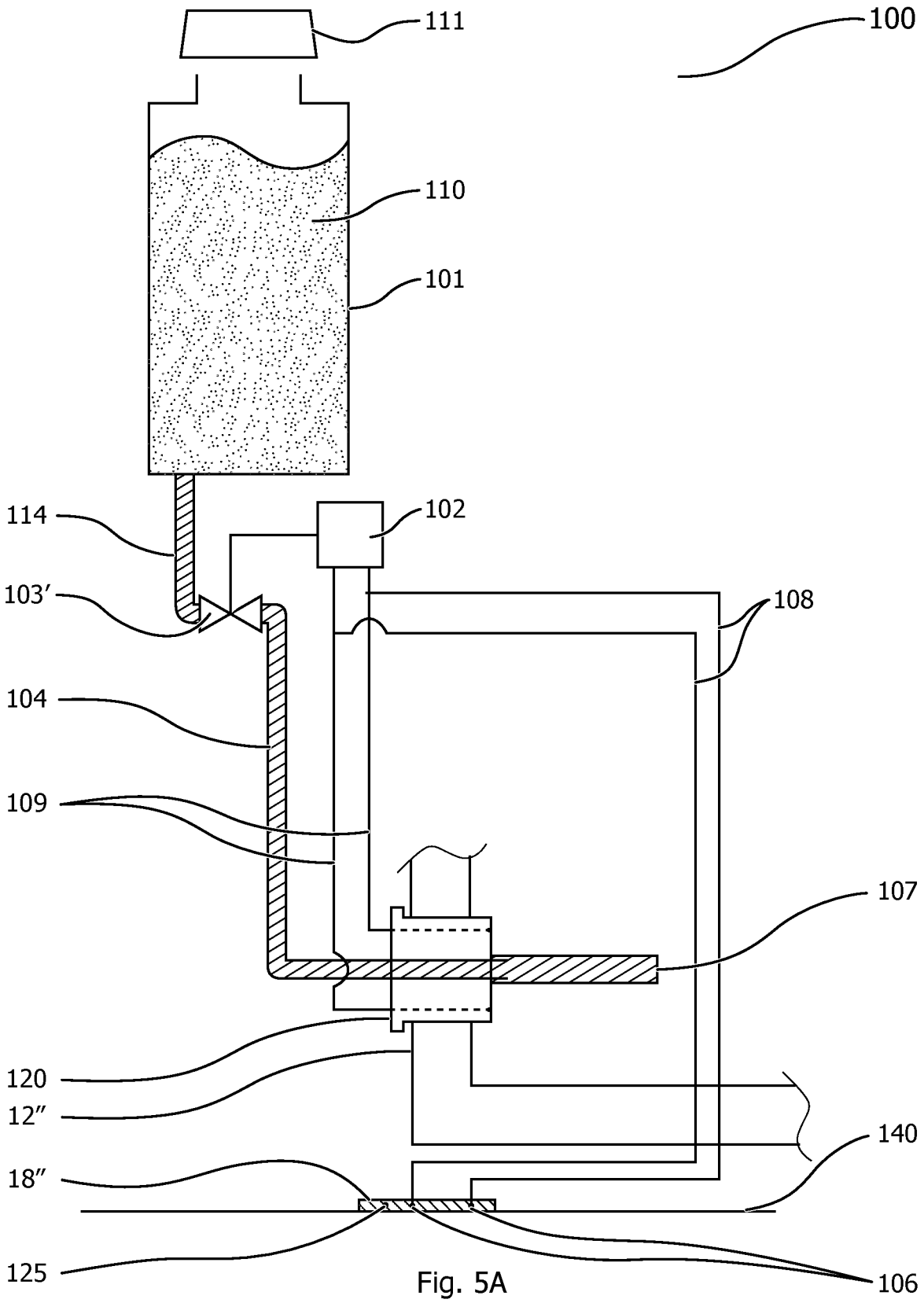
FIG. 5A is a schematic view of another embodiment of the condensate drain pain system according to the present invention in which an electrically-actuated valve, such as a solenoid valve, is used to control the flow of biocide or other liquid line cleaning liquid.

FIG. 5A schematically illustrates the main components of a condensate drain protection system 100' which is an embodiment very similar to FIG. 5 (like numerals are used to designate parts of like functionality), except an electrically-activated valve 103', such as a solenoid valve is used instead of the pump 103 of FIG. 5. The system includes a liquid storage and dispensing tank 101 which is initially filled with a biocide or other liquid line cleaning solution 110 and must be located above the dispensing tube 107 to allow a gravity flow of biocide liquid to enter the condensate drain pan 12". A cap 111 is used for ease of filling the tank and to prevent spillage from the dispensing tank. The biocide liquid 110 is dispensed into the condensate drain pan 12" of the air handler 1 shown in FIGS. 1 and 2 by an electrically-actuated valve 103' such as a solenoid valve instead of the pump used in the configuration of FIG. 5. An electronic circuit 102 controls the activation and timing of the valve 103'. When the valve is activated by the control electronics 102, the biocide liquid 110 flows from the biocide storage and dispensing tank 101 through a hose 114 leading to the inlet of the electrically-actuated valve 103', then from the valve 103' through the hose 104 to the passage through a sensor and dispensing fitting 120 and then down a dispensing tube 107 from which the liquid 110 falls into the condensate drain pan 12" inside the air handler 1 of FIG. 1 or 2. In another contemplated embodiment, the hose 114 would take alternate ingress paths from the exterior of the air handler into the condensate drain pan 12". The sensor and dispensing fitting 120 is typically inserted into the primary overflow fitting locations such as 14 in FIG. 1 or 13' in FIG. 2. A secondary overflow sensor (as shown in FIG. 8 described below) is then used in the secondary overflow fitting or in an overflow pan under the unit, or a secondary moisture or water indicating sensor can be placed on the floor under the unit as shown in FIG. 1.

In general, the use of a pump instead of a solenoid valve can provide a far more accurate dosage when the diameter and length of hoses 104, 114 as well as the hose flow path, elevation of the dispensing tank (relative to the dispensing fitting 120) and other installation variables are considered as well as other fluid flow considerations, such a viscosity changes with temperature and viscosity of different biocides to name just a few. It is also well known in the art that a positive displacement pump, or some other metering pump can provide the most exact and prescribed flow rate especially in conjunction with a feedback control so that the exact dosage is always known. However, to reduce cost, and because utmost accuracy is not needed, other lower-cost pumps are anticipated for this application. In our preferred embodiment, a peristaltic pump is contemplated, since the biocide fluid then only contacts the tubing and no moving parts of the pump, except the tubing which is being squeezed, is exposed to the fluid.

Figure 6:
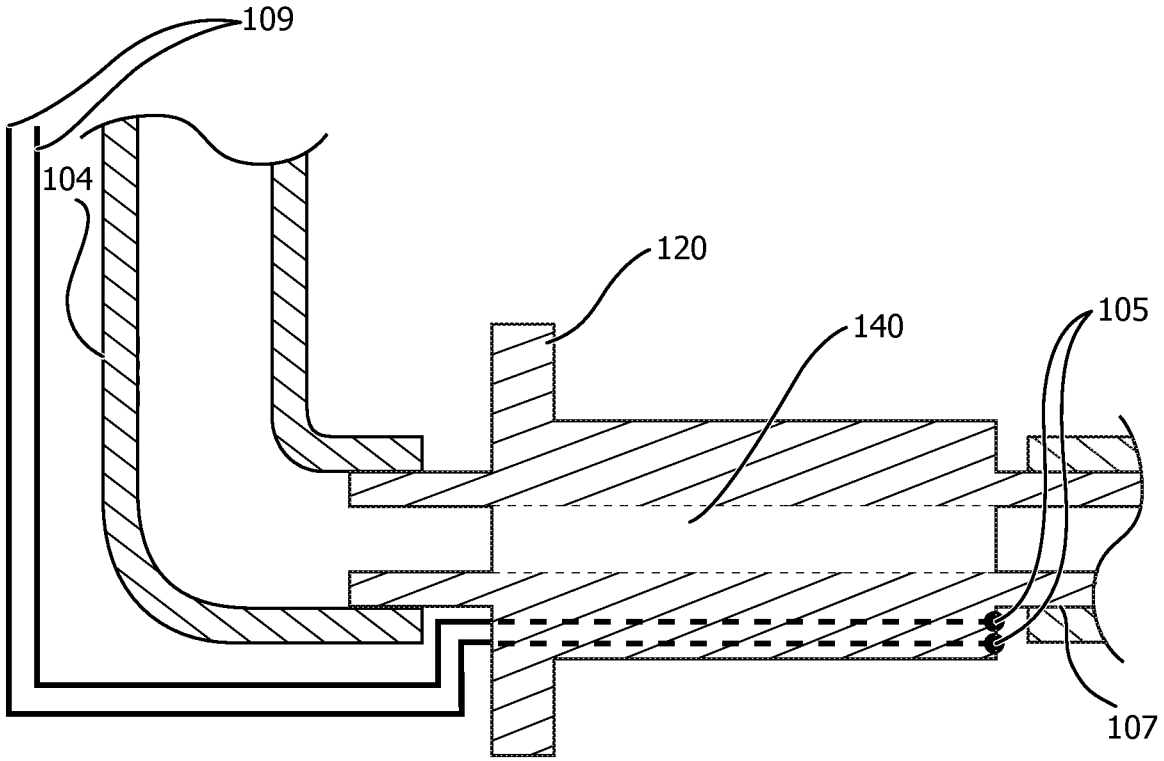
FIG. 6 is an isolated cross-sectional view of a sensor-injector portion of the system shown in FIGS. 5 and 5A.

FIG. 6 shows the above-mentioned sensor and dispensing fitting 120 which is inserted into the drain pan primary or secondary drain pan fitting. The electrical wires 109 from the electronic control 102 are connected to the electrodes 105 and the biocide dispensing hose 104 connects to a passage 140 in the drain pan fitting. The dispensing tube 107 is connected to the other end of the passage 140 and allows the biocide liquid to flow from the hose 104, through the fitting 120, through the tube 107 and into the drain pan. The dispensing tube 107 can be cut to a custom length at the installation site to assure that, regardless of the plumbing connection (such as using a tee as shown in 15 of FIG. 1 or connected directly to the primary or secondary connection of the drain pan) the extension tube is the proper length to allow the biocide to flow into the drain pan or other desired location.

Figure 7:
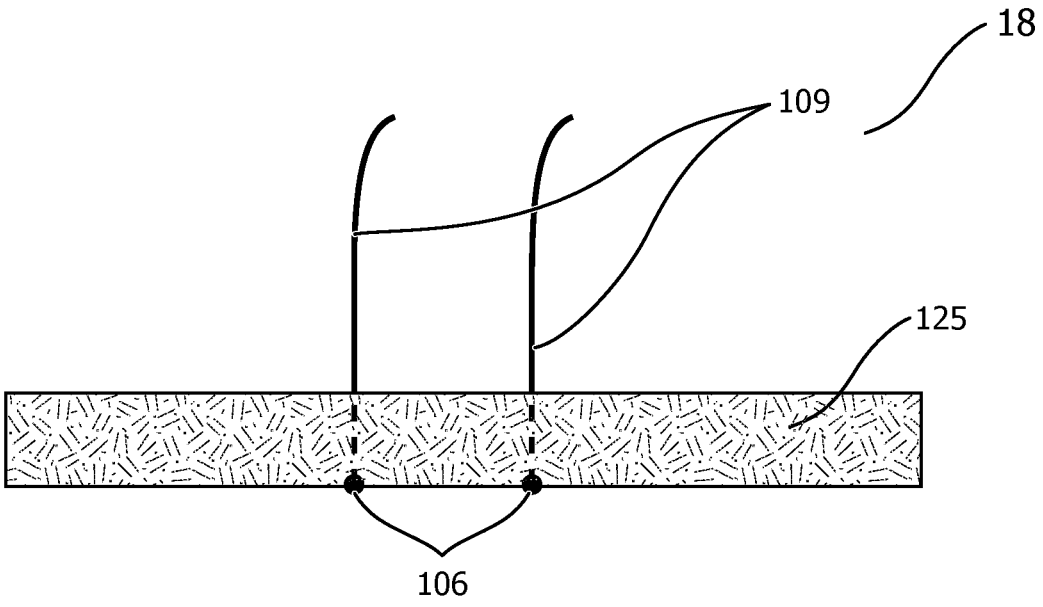
FIG. 7 is an isolated, schematic cross-sectional view of the wet surface sensor designed to detect moisture on a surface in the system of the present invention.

FIG. 7 shows the moisture detecting sensor assembly 18 which consists of two electrodes 106 located in a wicking or moisture absorbing material 125. This moisture detecting sensor can be placed in a secondary drain pan in place of a secondary float switch as shown 23' of FIG. 2 or on the floor under or around an air handler as shown as 18 in FIGS. 1 and 18' in FIG. 2.

FIG. 8 shows an alternative sensor embodiment in the form of a moisture detecting sensor 220 with electrodes 106 for being installed into a female plumbing fitting in a drain pan or overflow pan. Its construction is similar to the sensor and dispensing fitting 120 of FIG. 6 but without the biocide dispensing passage 140 and related biocide plumbing fittings. This moisture detecting sensor 220 is designed to be installed in a primary or secondary condensate drain pan fitting such as secondary fitting 13 in FIG. 1 or 14' in FIG. 2 or into the primary drain pan fittings such as 14 in FIG. 1 or 13' in FIG. 2, it being well known it the art to use both primary and secondary moisture or drain pan sensors.

Having explained the present invention thus far, it should now be clear to one skilled in the art that the moisture sensor with the biocide dispensing tube 120 can be connected to either the primary or secondary drain pan access fittings or the condensate drain line itself with a plumbing tee fitting as shown in FIGS. 1 and 2 and also that one or more additional moisture detecting sensors or switches can be connected into the either available drain pan access fitting or an overflow drain pan access pan fitting. In addition, a conductivity detecting pair of electrodes, or moisture indicating switch, 125 in the overflow pan or on the floor can be used. Furthermore, since electrical conductivity across the two electrodes 109 is used by the electronics 102 to detect moisture, as many sensors as desired as well as any combination of moisture or water indicating switches 18, sensor and biocide dispensing fittings 120, and moisture detecting sensor fittings 220 can be connected electrically in parallel, since continuity across any one or more sensors will have the same effect. These different sensors are all essentially low-cost electrodes placed in a primary or secondary location that would become wet (and thus conductive) if the condensate drain line is blocked or restricted. It should also be understood that a single pump (103 of FIG. 5) or solenoid can supply biocide to multiple sensor dispensing units such as 120 of FIGS. 5 and 6.

When electrical conductivity across the two electrodes 105 is detected by the electronic circuit 102, a switch or contact in the electronic control 102 is opened to open a low-voltage control circuit of the existing air conditioner, furnace or heat pump unit shutting off the unit and stopping the production of additional condensate or humidifier water. The specific control circuit that is interrupted can be either the low-voltage control circuit controlling the contactor (relay) for the compressor or all low-voltage power to air conditioner, humidifier, dehumidifier, furnace, heat pump or the like, which generates water, such as condensate from the air conditioner or water for the humidifier in the case of a furnace with humidifier. The operation of the low voltage control circuit and methods to open the circuit to either stop the compressor or stop all operation of the air conditioner or furnace are well known in the art.

The control electronics 102 can be continually powered by a low-voltage 24 VAC transformer of the control circuit of the air conditioner system (anytime the AC air handler unit is powered) or the control electronics 102 can be powered only when a low voltage control signal is sent to activate the compressor contactor (relay), that is for example when the "Y" or yellow compressor control circuit is activated in an air conditioner or heat pump. The control electronics 102 can be equipped with a battery, capacitor or the like to keep the timing circuit or clock operating even if the control electronics 102 are not powered in order to maintain the timing interval for dosing biocide.

The control electronics 102 can be wired into the air conditioner's low voltage control circuit to cut power to the entire control circuit or only to the compressor anytime conductivity is detected across any number of pairs of electrodes which are wired in parallel or any number of separate inputs designed into the control electronics, or a combination of both. In either case, the control electronics 102 can contain a timer which is continually powered as discussed above to assure that the biocide is dosed at a prescribed interval, e.g., no more frequently than once per month, if the air conditioner is activated (or the heat pump in cooling mode is activated) and not at all if the air conditioner is never activated such as during the winter months when heat is activated or the heat pump is in heating mode. Alternatively, the discharge of a battery or capacitor can be used to determine if a sufficient time has passed when the control electronics are once-again reactivated by low-voltage being applied to a control line, such as the Y compressor activation control circuit. That is, when the control electronics are reactivated by the control circuit and if the capacitor or battery is discharged, the control electronics can assume significant time has passed for the next dose to be administered.

Monthly biocide dosing is currently our preferred timing frequency. Of course, in geographical areas where biological growth is more active (such as warmer climates) the timing could be every two weeks or even every few days (even if only for certain periods of the year). The frequency of biocide dosing and the quantity of biocide distributed during a single dose could be adjusted depending not only on the time of the year but also depending on the outdoor temperature, i.e., more frequently during the warmest part of the year when biological growth is worse. We also contemplate that a user input could be made available where the user can adjust the frequency and/or quantity of biocide dosage by adjusting a control such as one or more potentiometers (e.g., duration and frequency) in the control electronics 102.

One or more additional pairs of electrodes 108 can be wired in parallel to the wiring 109 and therefore electrically in parallel to electrodes 105 shown in FIG. 5 to form one or more secondary moisture detecting sensors such that conductivity detected across any set of electrodes will halt air conditioner, humidifier or compressor operation. As shown in FIG. 3, a second pair of electrodes 106 is located in a moisture wicking or moisture absorbing material 125 such as felt, sponge or cloth to form a secondary moisture detecting sensor 18". This moisture detecting sensor can be located in a secondary drain pan such as 18 of FIG. 1 or 18' of FIG. 2.

It is important to also understand that the biocide shock treatment effect is mitigated by the quantity (volume) of condensate in the condensate drain pan and the condensate plumbing drain lines. Therefore, the ideal time to inject the biocide is at the start of any air conditioning cycle before condensate has a chance to form on the evaporator coils, since this is the period during the air conditioning cycle when the volume of condensate water in the pan is at a minimum. In this way, the biocide has minimal dilution with the condensate water in that the pan is essentially dry and, if not completely dry, any water that could have drained from the flow path or evaporated from the pan has already done so.

Injecting the biocide at a set frequency, such as monthly but only at the initiation of a thermostatic call for cooling, also provides the potential to clear a clogged line. If the condensate flow path is clogged and keeping the unit from operating, the biocide dosage might clear any clog, and the location of the high-condensate level shut off in the primary condensate drain line can be selected so that the additional small volume of the biocide liquid (on the order of several ounces) is insufficient of a volume to cause an overflow. The logic of the control electronics can be such that if the primary and/or secondary condensate level conductivity electrodes detect water so that air conditioner operation is prevented, an additional dose of biocide is delivered even if the scheduled time to deliver the next dosage has not been reached. This added dosage of biocide may clear the blockage, allowing the unit to once again operate normally. If the primary and secondary conductivity electrodes are not wired in parallel but instead on separate conductivity detection circuits, then the biocide dose could be repeated or increased if overflow to the secondary detector (i.e., water detection at the secondary conductivity sensor) has not occurred. This would allow the biocide concentration to be increased even further with the goal of increasing the odds of clearing the blockage.

The operation of the heating system or the operation of the compressor in heating for a heat pump need not be deactivated, since condensate is not formed in the indoor unit (air handler) during heating. However, to reduce cost and simplify installation, our currently preferred embodiment defeats the air conditioner, heat pump or even if desired a heating operation anytime water is detected at the primary or secondary conductivity electrodes. The moisture sensing system shut off detectors, i.e., the electrodes 105 and 106, could be used to deactivate the heating system humidifier or the entire heating system if an overflow due to faulty operation of the humidifier or failure of the humidifier to property drain should occur. The same control electronics 102 can also monitor for overflow of the air conditioner condensate drain system and/or the heating or humidifier system. One skilled in the art will appreciate that any number of additional conductivity sensors such as 18" shown in FIG. 5 or those placed into a plumbing circuit such as 120 shown in FIG. 4 can be placed in overflow locations of both systems and all wired in a parallel circuit, i.e., wired in parallel to the conductivity wires 108,109 to shut off both heating and cooling operations and dose additional biocide if water is detected.

A conductivity sensor to determine the presence of water, as opposed to a float switch, has the potential for false alarms caused by a small layer or droplet of water that spans between the two electrodes and thereby provides electrical conductivity even though there is essentially no water surrounding the sensor. One way to prevent such false alarms is to use more than just two conductivity electrodes (one sensor), instead using for example two sensors, which could be done with three electrodes (A, B, C), all on or near the same elevation. Then if conductivity is discovered found between all three combinations, i.e., conductivity between A-B, B-C and A-C, then the presence of moisture is far more probable. In addition, to provide a more tortuous path for the liquid water, one or more of the electrodes can be recessed rather that exposed. This will make it less likely that moisture will splash onto that electrode in the same fashion as the other electrodes. For example, if two sensors are located in the sensor housing (120 of FIG. 6 or 220 of FIG. 8) there would be three electrodes like 105 in device 120 in FIG. 6 or three electrodes 106 in FIG. 7, or three electrodes 125 in 220 instead of only two electrodes in these devices. Having been shown this concept, one skilled in the art can understand the progression of electrodes as more sensor circuits are located into a moisture detecting fitting, to prevent false alarms.

Figure 9:
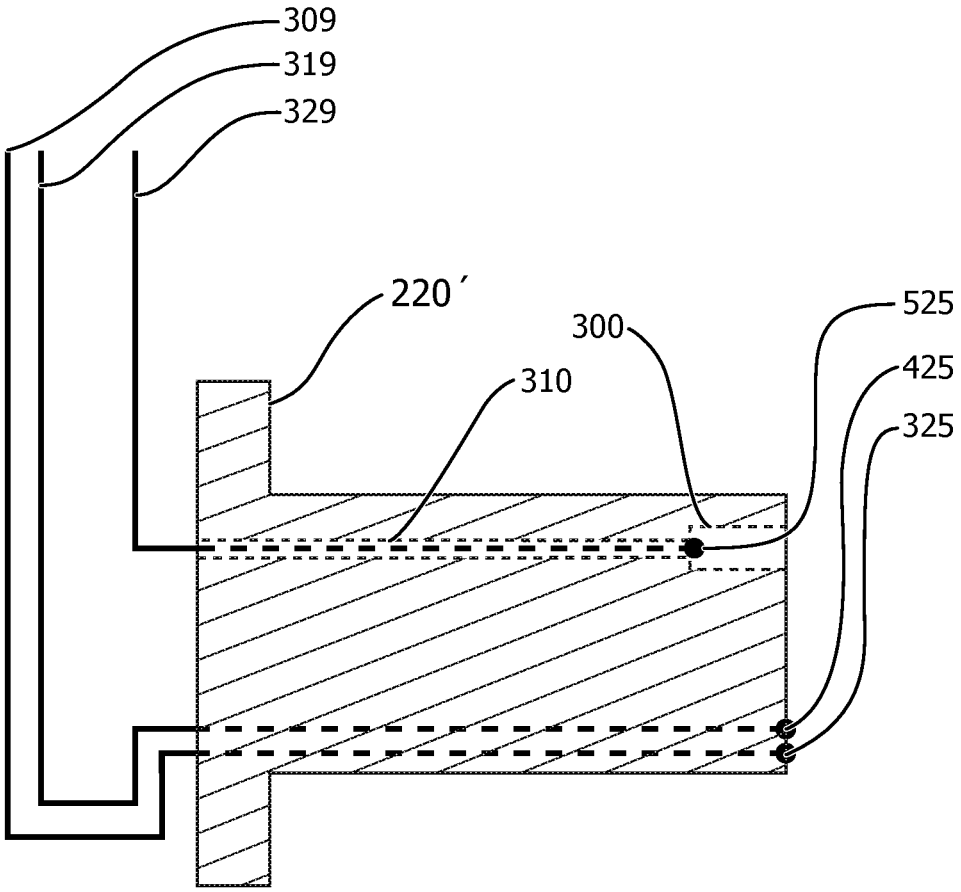
FIG. 9 is an isolated, schematic cross-sectional view of another embodiment of the moisture detecting sensor using three electrodes, with one electrode having an air flow path and recess to prevent residual water from accumulating across the electrodes.

We have also discovered that a superior method to assure that at least one common electrode is prevented from having a residual layer or drop of moisture on the sensor is to allow, using the natural pressure drop that exists between the inside and outside of the air handler, a small quantity of air flow along the electrode pathway in order to keep it dry or free from any residual moisture. The differential pressure that exists between the drain pan and the interior of the conditioned space, (i.e. the house) is caused by the pressure drop of the air flowing through the inlet grill, inlet ductwork and filter and into the region just upstream of the coil. The pressure of the exterior space around the air handler is at a slightly higher pressure than just inside the air handler. By locating a small air flow passageway from the outside to inside in the moisture detecting electrode fitting the electrode surface is therefore swept by a flow of air whenever the air handler is operational, thereby serving to keep the electrode free from any residual water. FIG. 9 shows an embodiment of an electrode configuration incorporated into the sensor fitting 220 of FIG. 8. It should be understood that these features could also be incorporated into the sensor-injector 120 of FIG. 6 or into some other fitting serving a similar purpose.

Referring now more specifically to FIG. 9, three electrodes 325, 425 and 525 are connected by wires 309, 319 and 329 to control electronics like that of the electronics 102 shown in FIG. 5. Three electrodes are used, instead of two, to reduce the possibility of false alarms. If conductivity is discovered between the electrodes 325, 525 as well as conductivity between the electrodes 425, 525 (and optionally also between the electrodes 325, 425) the presence of water at this location can be assumed. Furthermore, electrode 525 has been recessed into the depression 300 of FIG. 9 to provide a more tortuous path for the liquid water. Finally, the electrode 525 is also in the airflow path from outside the air handler to the inside due to the passage 310, which allows the differential air pressure to cause air to flow over the electrode 525. Of course, one skilled in the art would understand that the recess 300 or air flow pathway 310 could be used on any of the electrodes 325, 425 or 525, and the concept just described is not limited to using only three electrodes.

Figure 10:
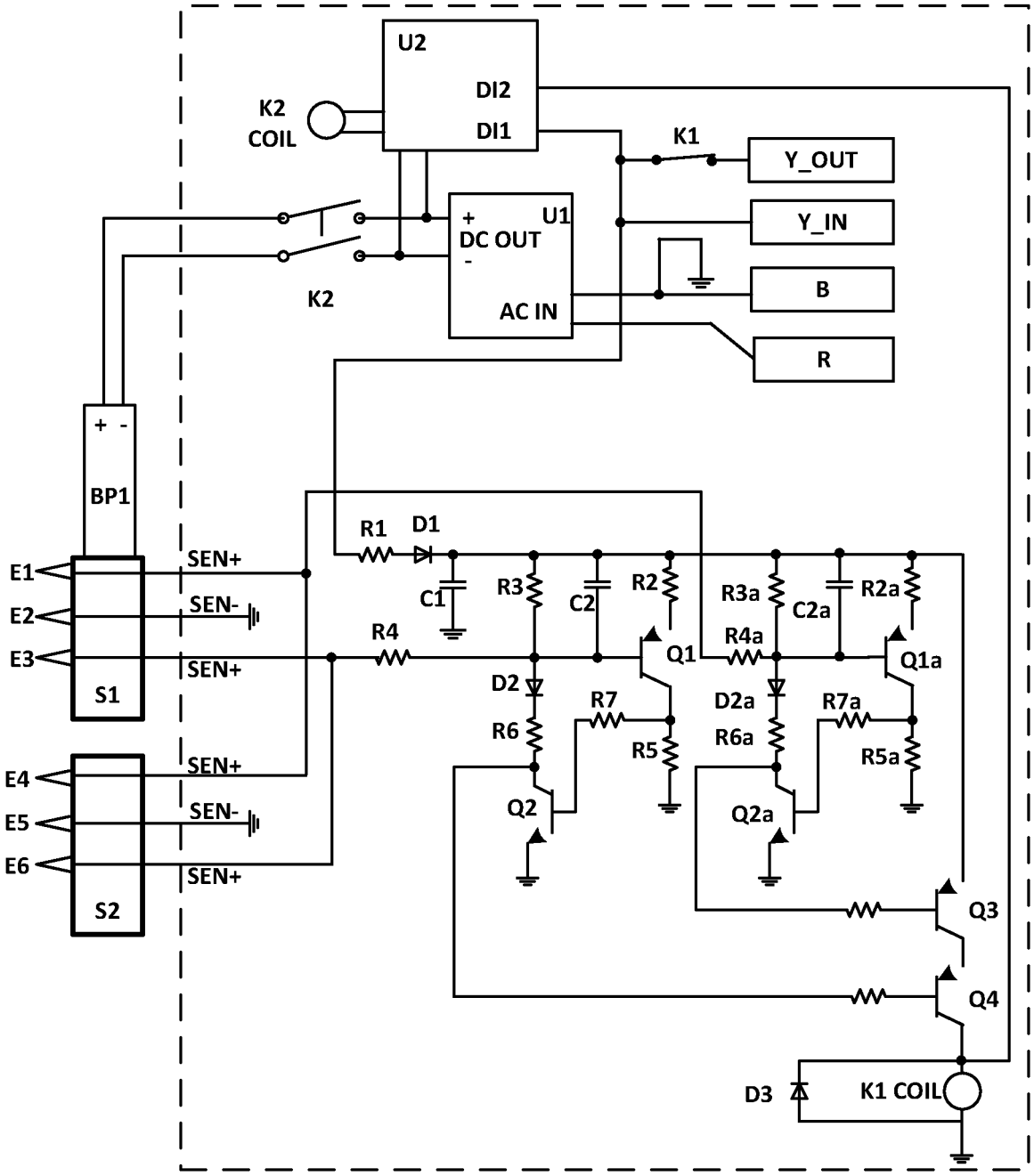
FIG. 10 is a circuit diagram of one embodiment of the system electronics of the present invention where, after the electronic detection of water at both water sensors (electrode pairs), which is performed in a combined circuit, occurs, an alarm situation is then reported to the microprocessor and equipment operation is halted.

FIG. 10 shows a known electronic control configuration for the electronic circuit 102 shown in FIG. 5. In this embodiment, the electronic controller circuit 102 of FIG. 5 uses duplicate water sensing circuits in a single moisture detecting sensor of the type shown in FIG. 9. Both water sensing circuits are needed to detect water for activating an alarm condition, i.e., they both must detect continuity to avoid false triggering. To reduce cost, the primary and secondary water sensors are wired in parallel so that either water sensor S1 or water sensor S2 of FIG. 10 can trigger the alarm state. Because of the parallel electrical wiring of the electrodes of the two water sensors, one circuit from each sensor can also trigger the alarm state. For example, continuity between electrodes E1, E2 and continuity between E2, E3 (both sensors detecting water) would trigger the alarm as would continuity between E1, E2 and continuity between E5, E6 since E5, E2 are electrically connected as are E6, E3. The circuitry and components of both water sensing circuits are identical and component designators that end in an "a" are duplicate components in the second water sensing circuit.

When 24 volts AC is applied to the Y_IN and B terminals from a system control transformer (not shown), the voltage is rectified and filtered to create a raw DC voltage using resistor R1, diode D1, and capacitor C1, which is well known in the art. This raw DC supplies the power to the moisture sensing circuits.

E1, E2, and E3 are electrodes in water sensor S1 and E2 is the common electrode. The electrodes E1, E2 and E3 could, for example, equate to the electrodes 425, 325, 525, respectively, of FIG. 9. Likewise, E4, E5, and E6 could equate to the electrodes in the second water sensor S2. One skilled in the art now having seen this electronic control circuit would be able to modify it to utilize three or more water sensors.

If the condensate bridges the gap between E2, E3 or between E5, E6, for example, then current through one or both of the emitter-follower amplifier circuits will increase. This will cause the current through resistor R5 to increase and the node that both resistors R5, R7 share will rise in voltage. When this voltage exceeds the forward voltage of the base-emitter junction of the transistor Q2, the latter will turn on and provide a path for emitter-base current to flow through transistor Q1 and latch both transistors Q1, Q2 on. This is the first water detecting latching circuit.

If the condensate bridges the gap between E1, E2 or between E4, E5, for example, then current through one or both of the emitter-follower amplifier circuits will increase causing the current through resistor R5*a* to increase, and the node that both resistors R5*a*, R7*a* share will have a voltage rise. When this voltage exceeds the forward voltage of the base-emitter junction of the transistor Q2*a*, it will turn on providing a path for emitter-base current to flow through transistor Q1*a* and latch both transistors Q1*a*, Q2*a* on. This is the second water detecting latching circuit.

Only one of the latching circuits being energized means that only one pair of electrodes is bridged (showing conductivity between them) and not both pairs. As stated earlier, to prevent false alarms both pairs of electrodes (where E2, E5 are common to each of the two pairs) in a water sensor (or one pair from each water sensor, as discussed earlier, because of the parallel wiring arrangement) must be bridged.

When both latching circuits described above are energized, the latching circuits will cause the transistors Q3, Q4 to turn on and allow current to flow through the coil of relay K1. The normally closed contacts on K1 will open and turn off and open the Y_in-Y_out connection. The K1 contacts being wired in series with the low-voltage compressor control wire (typically referred to in the trade as the Yellow wire or "Y" wire) which activates the contactor (not shown) which, when closed, activates the vapor compression system compressor (not shown). Therefore, breaking the Y wire control circuit will shut off the compressor, thereby preventing any further production of condensate.

When used with a humidifier instead of a condensing unit, the wire in the circuit of FIG. 10 that would be wired into the Yin-Yout connection is the control wire that, when open, deactivates the flow of water to the humidifier. Likewise, in any other application where this circuit is used, the Yin-Yout connection is wired in series into the control circuit that stops the production of water when the circuit is opened.

Q1, R2, R3, R4 and R5 make up a well-known emitter-follower amplifier which amplifies the current flowing from SEN+ to the SEN− terminals. C2 provides both a power on reset and slows the response of the emitter-follower amplifier. Q2, D2, R6, and R7 make up a latch circuit. Transistors Q3, Q4 drive the coil of K1.

K1 is a normally closed relay that switches the compressor control voltage flowing from the Y_IN terminal to the YOUT terminal. D3 is a free-wheeling diode which protects transistors Q3, Q4 from voltage kickback from the coil of relay K1. U1 is an AC-to-DC converter that takes in 24 VAC and provides a lower DC voltage to power the biocide pump BP1 (assuming the biocide pump is a DC pump as in this embodiment) and microprocessor U2. The microprocessor U2 is used among other things to; turn on/off relay K2 for controlling the biocide pump BP1, keep track of when and for how long to activate the biocide pump BP1 based on preprogrammed commands, record any alarms states and predict and avoid false alarms from keeping the air conditioner from operating.

For example, the microprocessor U2 can use an internal clock to determine if the air conditioner has not been used for a certain period of time. The microprocessor is powered from the low-voltage power (R and B terminals in FIG. 10) and is always activated when the circuit is powered, or a battery backup could be used. The microprocessor also determines that, if there were no water alarms when the air conditioner last shut down, startup of the system should not be prevented due to water currently being detected at the moisture or water indicating switches or sensors. That is, while water may be present for many reasons, the water being detected is not due to the actions of the air conditioner since it was not running and there was no water problem the last time it was running. Therefore, in this situation, stopping the operation of the air conditioner is not necessary, especially since the air conditioner can be used to dry the conditioned space and potentially help improve the flooded area or reduce the formation of mold in the wetted area. If the air conditioner is submerged or otherwise too wet to operate, other safety circuitry (e.g., circuit breakers in the system) would keep the unit from running. The point being made here is that the water at the water sensors is not due to the air conditioner's operation in this case, and therefore the air conditioner should not be prevented from operating.

Examples of other intelligent decisions that could be programed into the microprocessor U2 include how to deal with periodic water alarms. For example, if the water sensors are periodically turning the air conditioning unit off (due, say, to a water alarm) then back on again in some repeated fashion, this could signify a slow draining condensate drain line. That is, the air conditioner is producing more condensate than can flow out of the drain pan and out the condensate drain line system one possible cause being a restriction in the condensate drain line flow path caused by biological growth. The microprocessor U2 could then "shock" the condensate drain flow path with a dramatic increase the amount of biocide administered into the drain line, for clearing the line with the large one time increase biocide concentration.

Figure 11:
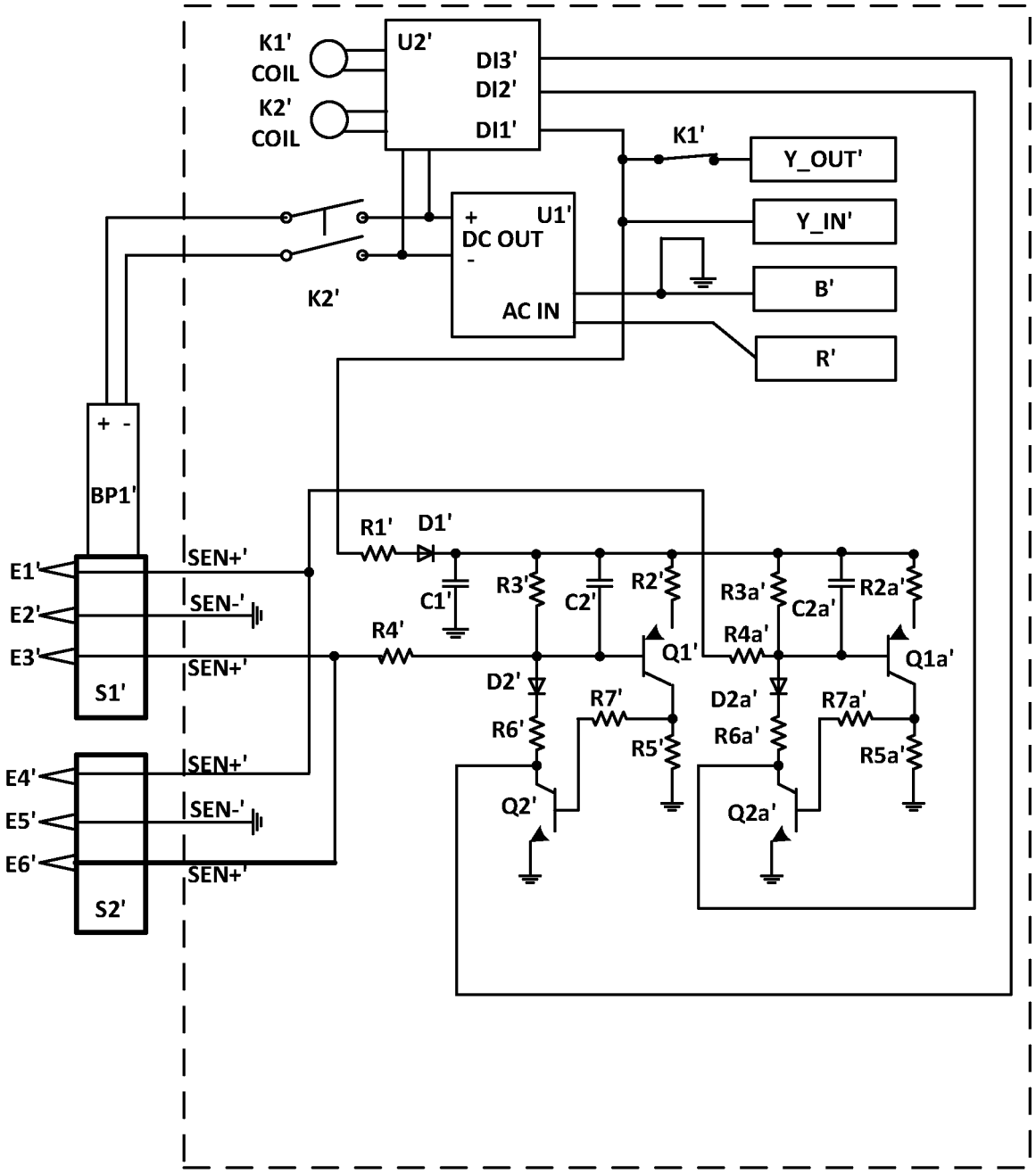
FIG. 11 is a circuit diagram like that of FIG. 10 except that the detection of water at each moisture sensor (electrode pair) is reported separately to a microprocessor, and the microprocessor determines the alarm situation either only when both the electronic circuits for both pairs of electrodes individually report water at their respective electrodes (i.e., continuity across the electrodes) or, when the primary moisture sensor of the electrode pair determines an alarm situation, and the secondary does not, the operation of the unit is halted and lethal biocide or other liquid line cleaning solution injection is initiated and halted at some point up to detection of moisture also at the secondary moisture sensor.

As yet another example, the water sensors need not be wired in parallel as above described, but instead each circuit could individually alarm the microprocessor so that the microprocessor could detect which water sensor was providing the alarm as shown in FIG. 11 (where components having similar functionality to those of FIG. 10 are designated with the same numeral but primed) If the secondary water sensor was providing an alarm without an alarm from the primary water sensor, this could provide an indication that the primary water sensor is not functioning for some reason. The circuit diagram shown in FIG. 11 is otherwise like that of FIG. 10 except that in the former detection of water at each sensor is reported separately to allow additional intelligent alarm decisions to be made.

When 24 volts AC is applied to the Y_IN' and B' terminals from the system control transformer (not shown) in the circuit of FIG. 11, the voltage is rectified and filtered to create a raw DC voltage using resistor R1', diode D1', and capacitor C1', as is well known in the art. This raw DC will supply power to the moisture sensing circuits. E1', E2', E3' are electrodes in water sensor S1' and E2' is the common electrode. The electrodes E1', E2' and E3' could equate, for example, to the electrodes 425, 325, 525 of FIG. 9. Likewise, E4', E5', E6' refer to electrodes in the second water sensor S2'. Again, one skilled in the art having seen this circuit will now easily understand how to modify this circuitry to utilize three or more water sensors.

If the condensate bridges the gap between E2', E3' or between E5', E6', then current through one or both of the emitter-follower amplifier circuits will increase causing the current through resistor R5' to increase, and the node that both resistors R5', R7' share will have a voltage rise. When this voltage exceeds the forward voltage of the base-emitter junction of the transistor Q2', that transistor will turn on to provide a path for emitter-base current to flow through transistor Q1' and latch both transistors Q1', Q2' on. When this happens, both latching circuits will turn on which is monitored by the digital input DI3' of the microprocessor U2'.

Likewise, if the condensate bridges the gap between E1', E2' or between E4', E5', then current through one or both of the emitter-follower amplifier circuits will increase to cause the current through resistor R5*a*' to increase, and the node that both resistors R5*a*', R7*a*' share will have a voltage rise. When this voltage exceeds the forward voltage of the base-emitter junction of the transistor Q2*a*', that transistor will turn on to provide a path for emitter-base current to flow through transistor Q1*a*' and latch both transistors Q1*a*', Q2*a*' on. When this occurs, both latching circuits will turn on which is monitored by the digital input DI2' of microprocessor U2'.

The microprocessor U2', thus having received alarm status on digital lines DI2' and DI3', will open the normally closed contacts on K1'. That is, the microprocessor U2' will open the Yin'-Yout' connection. The K1' contacts being wired in series with a low-voltage compressor control wire, the vapor compression system compressor (not shown) will be activated when the contactor is closed. Therefore, breaking the Y-wire control circuit will shut off the compressor, thereby preventing any further production of condensate.

When used with a humidifier instead of a condensing unit, the wire that would be wired into the Yin"-Yout connection in the circuit of FIG. 11 is the control wire that when open deactivates the flow of water to the humidifier. Likewise, in other applications where this device can be used, the Yin'-Yout' connection will be wired in series into the control circuit to stops the production of water when the circuit is opened.

As in the circuit of FIG. 10, U1' is an AC-to-DC converter that takes in 24 VAC and provides a lower DC voltage to power the biocide pump BP1' (assuming the biocide pump is a DC pump as in this embodiment) and microprocessor U2'. Microprocessor U2' is used, among other things, to turn on/off relay K2' for controlling biocide pump BP1', keep track of when and for how long to activate the biocide pump BP1 based on preprogrammed commands, record any alarms states, and predict and avoid false alarms from keeping the air conditioner from operating.

The microprocessors of FIG. 10 or 11 could also be connected, via the Internet or other wired or wireless apparatus to an offsite alarm system to alert technicians of the repair needed at the location. In addition, as is well known in the art, three electrodes sharing a common electrode, such as the configuration shown in FIG. 9, could be used in place of the two pairs of electrodes shown in either FIG. 10 or 11.

Figure 12:
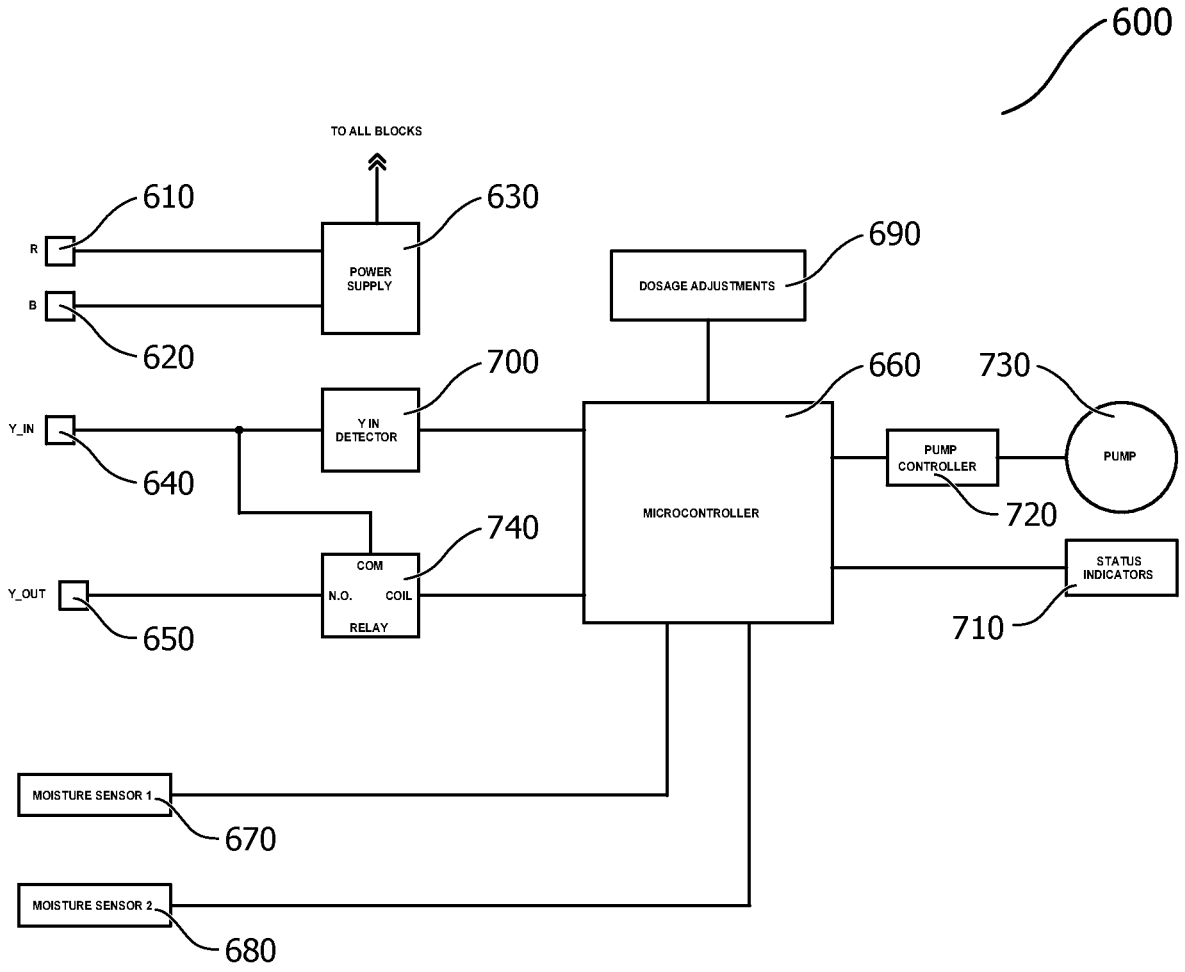
FIG. 12 is a circuit diagram of a microprocessor-based control electronic unit instead of using discrete electronic components like those used in the control electronic units of FIGS. 10 and 11.

FIG. 12 is an electrical schematic of an alternative embodiment of the overall logic design for the electronic control 102 of FIGS. 5 and 5A. One skilled in the art will understand that the specific circuits shown in FIGS. 10 and 11 can be achieved in any number of methods and that FIG. 12 provides the basic overall electrical performance requirements of any number of circuits that could achieve this control task. In FIG. 12 R and B correspond to the 24 VAC Line R and Neutral B which will power the electronic circuit 102 in FIGS. 5, 5A and 15. Power Supply converts the 24 VAC power into the voltage needed to power all the electronics. Y_IN is the cooling signal from the system thermostat. Y_OUT is the cooling signal output to activate the relay that operates the compressor in the outdoor unit, and it is the operation of compressor which generates the moisture that is captured in the condensate pan. MICROCONTROLLER is used to detect continuity and therefore moisture from the electrodes of MOISTURE SENSOR_1 and/or MOISTURE SENSOR_2. The duration and therefore the volume of the biocide or liquid cleaning solution is determined by the DOSAGE ADJUSTMENTS using switches and/or potentiometers. The Y_IN DETECTOR is a voltage detector to determine if the Y_IN signal from the thermostat is active and convert the signal to a lower voltage to input signal to the MICROCONTROLLER. STATUS INDICATORS is a display and/or LEDs to indicate the status condition of the dispenser. PUMP CONTROLLER converts the control signal from the MICROCONTROLLER to a suitable voltage and current necessary to power the PUMP which dispenses the biocide or liquid cleaning solution. MOISTURE SENSOR_1 represents the electrode pair used to indicate the present of water in the primary location. MOISTURE SENSOR_2 represents the second moisture sensor electrode pair used to indicate the present of water in a secondary location RELAY makes or breaks the Y_OUT signal the outdoor unit based on the moisture sensor inputs, time since last pump activation, and other environmental factors described above (including time of year, users preferred operational frequency, geographical location, and outdoor air temperature) and programmed into the MICROCONTROLLER.

Another type of air conditioner or heat pump gaining wide acceptance is the mini-split. The mini-split air conditioner or heat pump is a smaller air conditioner typically used for cooling a single room (although it can be used with other mini-splits to cool multiple rooms). Unlike a conventional split-system air conditioner or heat pump where the air handler is large and located in an attic, closet or some other out of sight location, the mini-split air handler is located directly on the interior wall of the structure being conditioned. In a conventional split AC unit, the liquid dispenser and monitoring assembly of the present invention can be located out of sight along with the air handler. The mini-split air handler is in full sight, however, and the addition of the present invention to it, while still possible, could be considered an unsightly addition to the interior décor (on difficult to locate in a nearby closet for example). We have discovered how to employ the present invention at an alternate location and with a slightly modified configuration for mini-split and other similar applications.

Figure 13:
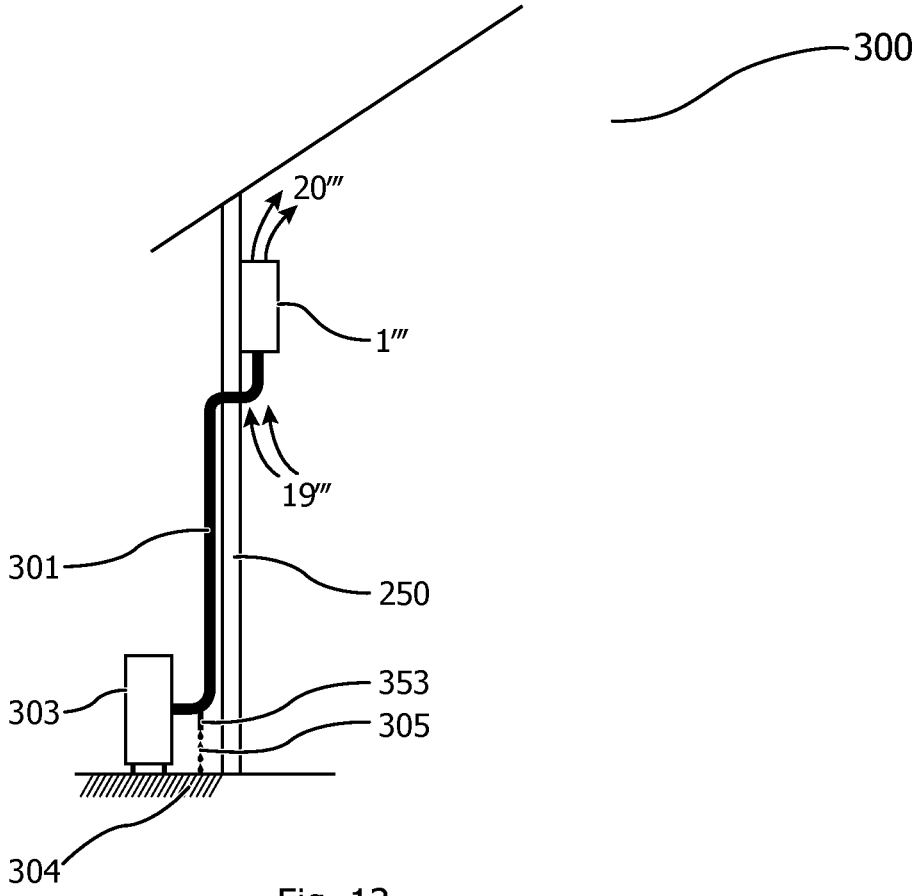
FIG. 13 is a schematic elevational view of a conventional mini-split air conditioning unit mounted on an exterior wall of a conditioned structure.

FIG. 13 shows a typical mini-split configuration designated generally by numeral; 300 with the indoor air handler 1' located on an interior wall 250 of the structure (such as a residential home or office) and the outdoor unit 303, typically referred to in the HVAC trade as the condensing unit, located on the outside of the structure. Conditioned air designated by arrows 19''' enters and leaves the air handler 1''' in various directions as determined by individual manufacturers as is well known in the art. An umbilical cord assembly 301 connects the indoor air handler 1''' with the outdoor unit 303 and contains, as a minimum, high-pressure and low-pressure refrigerant lines running between the two units as well as the condensate drain line which carries the condensate from the drain pan of the air handler 1''' to the outside of the structure. Power and control wires can also be included in the umbilical cord assembly 301.

Figure 14:
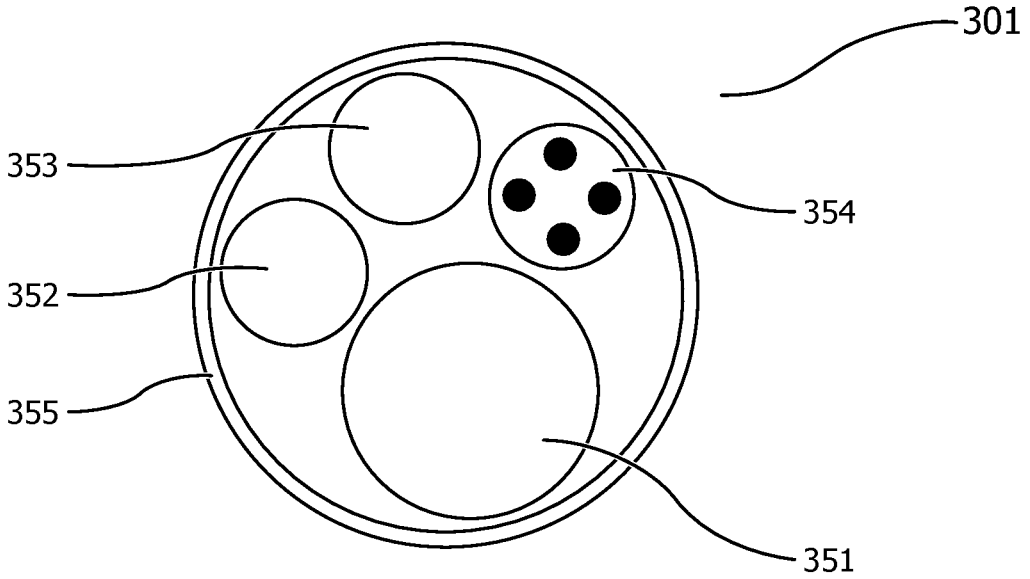
FIG. 14 is a cross-sectional view of a generalized type of umbilical cord that connects, communicates and powers the indoor air handler section of a conventional mini-split with the outdoor unit of the mini-split air conditioner or heat pump of the type shown in FIG. 13.

FIG. 14 is an enlarged cross-sectional view of a generalized representation of the umbilical cord 301 showing the condensate drain line 353, the high-pressure refrigerant line 352, the low-pressure refrigerant line 351 and the power and control wire bundle 354.

The condensate drain line 353 inside the umbilical assembly exits outside the structure, so that the condensate 305 can drain to the ground outside the structure. Like other split system air conditioners, the condensate liquid flows by gravity and is easily clogged by biological growth. However, because the min-split is a smaller unit (both in terms of size and cooling capacity) the condensate drain line is also much smaller being typically only ⅜ or ⅝-inch inside diameter, making this small condensate line even more likely to clog when compared to the larger diameter drain lines used in traditional larger split-system air conditioning units.

If the prevent invention cannot be used in the previously described location, i.e., in an area near the condensate drain pan, or is simply unsightly in this location an alternative configuration can be employed. Of course, one skilled in the art will now understand that the present invention can be remotely located or located outside at the outdoor unit 303 of FIG. 13, and the condensate feed line 104 of FIG. 5 can be routed inside the umbilical cord 301 of FIG. 13 along with moisture sensor wires such as 108, 109 of FIG. 5, to allow one of more moisture sensors to be located in the mini-split air handler drain pan and in a potential water overflow location. However, for these mini-split applications (especially when the present invention is to be retrofitted to an existing unit), a different configuration is contemplated and will not require additional plumbing line. That is, the retrofit installation of the liquid dispensing line such as 104 of FIG. 5 into an existing umbilical cord will not be required. Even the less difficult installation of the moisture sensor wiring can be avoided if desired.

Figure 15:
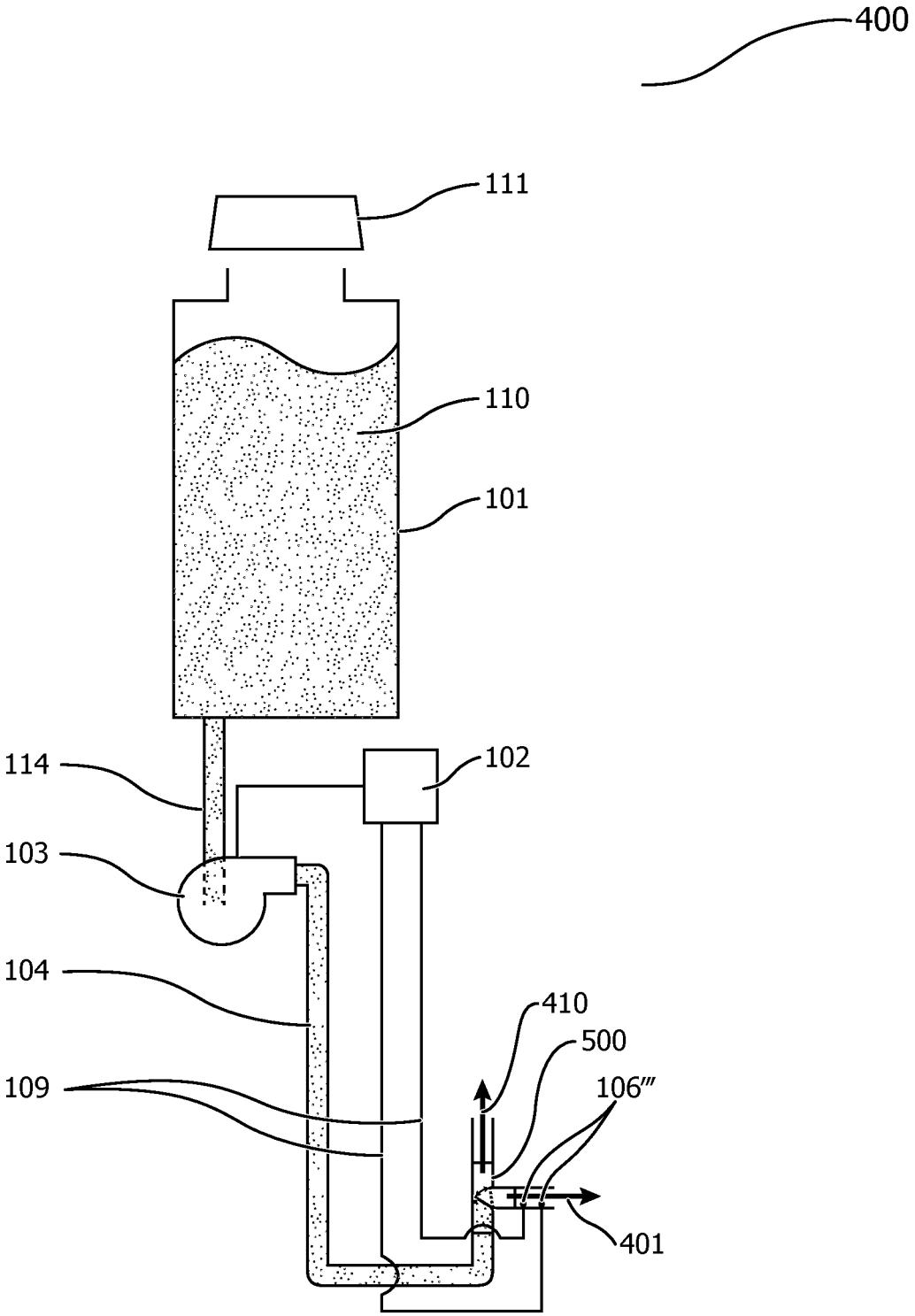
FIG. 15 is a schematic view of one currently preferred embodiment of the condensate drain pain and condensate drain line cleaning system of the present invention configured for use with a conventional mini-split heat pump.

In this alternative installation configuration, the liquid dispensing line 104 in FIG. 5 is connected to the condensate outlet of the existing condensate drain line 353 of FIG. 13 after it exits the umbilical cord 301 outside of the structure. This connection to the condensate drain line 104 is enabled by using a commercially available flow directing 3-way valve or tee 500 as shown in FIG. 15. As is well known in the art, such a three-way valve can be electrically actuated by the control electronics 102 or activated by the pressure of the liquid being dispensed in line 104 (this pressure being created by the operation of the pump 103 which is controlled by the control electronics 102).

In the embodiment of FIG. 15, the clog-clearing liquid is dispensed counter-current to the normal condensate flow either periodically or when a clog is suspected using the same logic and one or more sensors as previously described. However, the use of one or more moisture sensors (electrode pairs) in or under the drain pan of the mini-split air handler configuration would require the installation of additional sensor wires into the umbilical cord assembly of FIG. 14 for the moisture detecting electrodes that would be added in the condensate pan of the air handler or to overflow regions below the overflow pan. However, an alternative configuration that does not require the routing of any additional sensor wires is also possible. Thus, our system for preventing condensate drain pan flooding can be located outside either attached to or near the outdoor unit, and can shut down the entire unit or the air handler from outside without the need for any control wires to be added to the mini-split. It can also be powered from the outdoor unit. Therefore, the ability to avoid the addition of moisture sensor wiring in the umbilical cord makes a retrofit installation simpler.

Figure 16:
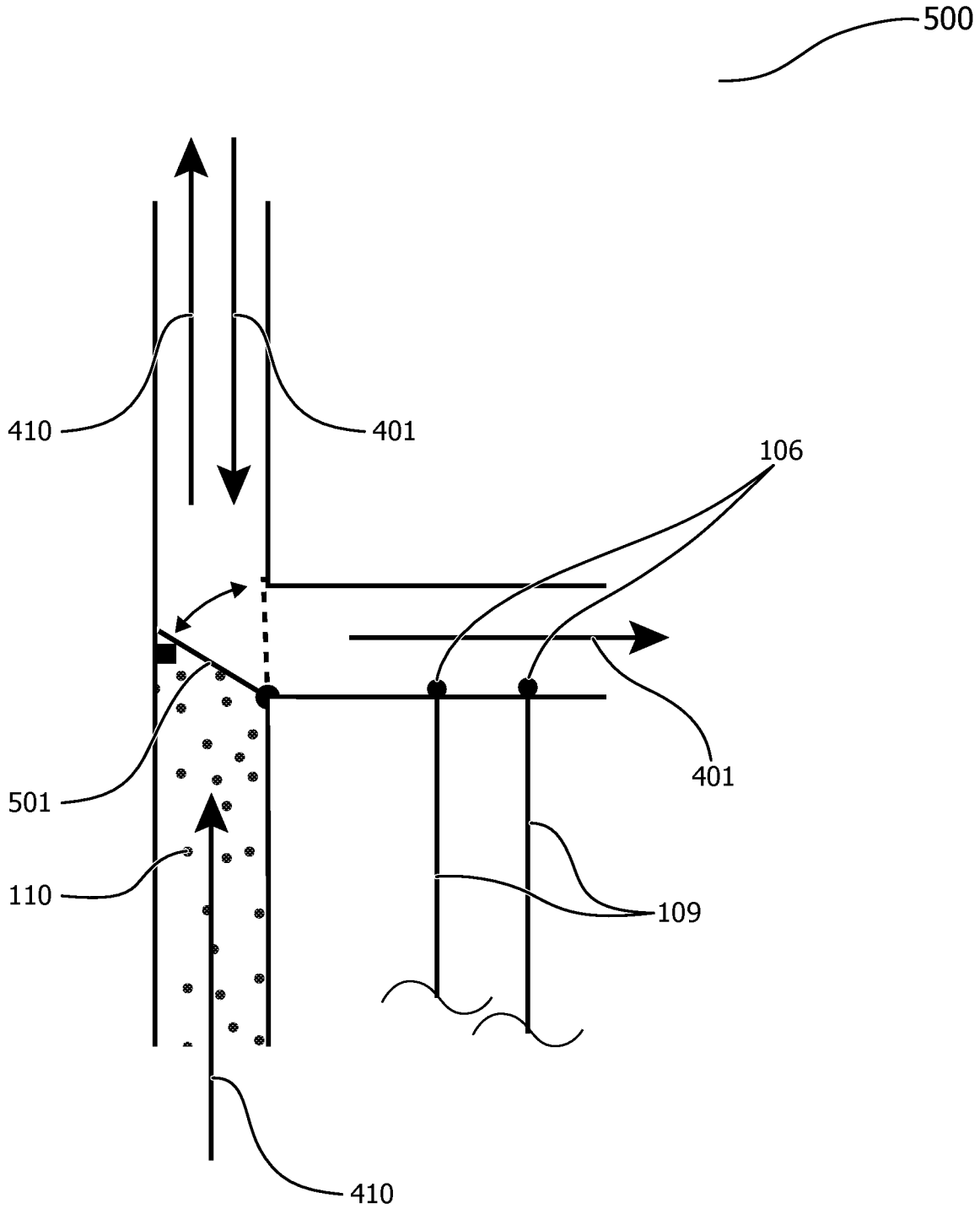
FIG. 16 is a schematic partial view of one embodiment of a condensate line fluid flow-directing tee with two integrated moisture detecting electrodes.

As discussed earlier, the control electronics of FIGS. 10 and 11 contain a microprocessor which is capable of performing logic decisions. Therefore, rather than sense moisture as a result of an overflow and shut down a system, (or in addition to performing this test), another approach is to sense the lack of moisture generation and condensate outflow after the system has been operating for a period of time (adjusted by the user based on, for example, the geographical location and installation factors, among other things well understood in the art). FIG. 16 is a schematic showing of the three-way valve or tee 500 described with reference to FIG. 15 where the flow-directing door or gate 501 is shown in a position that allows the condensate liquid from the air handler 401 to flow out of the system and contact the electrodes 106 as the condensate liquid exits. If after the air conditioner has been operating for a predetermined time period and no moisture has been detected at the electrodes 106, the control electronics 102 of FIG. 15 is programmed to assume that the condensate line is clogged. At that time operation of the pump 103 of FIG. 15 is initiated and the valve position, such as the flapper 501 of FIG. 16 or equivalent, is changed to pump the clog-clearing liquid in line 104 to flow in the direction shown by arrow 410, thereby forcing the cleaning or clog-clearing solution into the condensate line and up into the air handler condensate pan. Of course, the line clearing pump 103 of FIG. 15 could also be activated at predetermined intervals to prevent the potential clogging of the line in the first place as described previously.

Unlike the embodiment of our invention where the liquid line cleaning solution or biocide is introduced to the drain pan at the initialization of the cooling cycle, so that the strong cleaning solution would become minimally diluted but still flow with the condensate and in the same direction as the condensate, the embodiment of FIGS. 15 and 16 requires the cleaning solution to be pumped in the opposite flow direction, i.e., from the outside of the structure back up to the drain pan. We have found, however, that this makes the quantity of cleaning solution introduced to the system more sensitive and requires field adjustment by the installer to assure that sufficient liquid cleaning solution is introduced to flow completely through all the lines and up into the drain pan but also the quantity is not excessive so as to cause the cleaning solution to overflow the drain pan. Since any water being generated or flowing in the condensate drain line would change the necessary flow volume, the introduction of the cleaning solution in this configuration, is best done when the cooling operation is temporarily suspended (i.e., when no moisture is being generated). Therefore, when the allotted period for flushing the condensate drain line been reached and the next call for cooling has been initiated (which could be quite some time later if the cooling function has been off because it is winter), the cleaning operation will be performed before the unit is allowed to begin cooling and is generating condensate.

As discussed previously, if the unit has not detected any liquid condensate after operating for a predetermined period and the line cleaning is to be initiated, the cooling operation is halted until the cleaning operation is completed. In this case, however, the pressure developed by the pump 103 of FIG. 15 will generate sufficient pressure head to assure the clearing of any possible blockage and the cooling operation can be restarted after completion of this cleaning operation. Therefore, if a false positive clogged line condition was predicted due to the lack of condensate flow, the only disadvantage to preforming this potentially unnecessary line cleaning would be the use of some additional line cleaning solution. Nonetheless, the advantage of this configuration, which may make it a preferred configuration for some equipment owners and used in all split systems and not just mini-splits, is the use of the pump, not the cleaning solution alone, to positively clean the condensate drain line.

While we have shown and described several embodiments in accordance with our invention, we do not intend to be limited to the details but rather intend to cover all changes and modifications that are fairly encompassed by the scope of the appended claims.

We claim:

1. An anti-clogging liquid dispersion method for preventing flooding in a condensate drain pan or drain line of an air conditioner or heat pump air handler, comprising periodically supplying anti-clogging liquid to a drain line via the condensate drain pan or directly to the drain line, sensing moisture in the air handler region to monitor at least one of overflow of the condensate drain pan and a humidifier, and supplying an additional dose of the liquid at any time when at least one of an unacceptable amount of condensate moisture and a clogged drain line has been detected; and wherein the step of sensing moisture includes employing separate moisture sensors that can individually sense an alarm condition and deciding which one of the sensors is providing the alarm condition.

2. The method of claim 1, where the liquid is a cleaner selected to remove drain line blockage.

3. The method of claim 1, where the liquid is a biocide.

4. The method of claim 1, wherein the periodic supply to the drain pan is selected to occur before (a) condensate has begun to occur on coils of the air handler or (b) a dehumidification function of the air conditioner has begun.

5. The method of claim 1, wherein the step of sensing moisture includes providing a tortuous path for moisture in an electrode pathway.

6. The method of claim 1, wherein the step of sensing moisture includes sensing moisture in two separate sensing circuits before activating an alarm condition.

7. The method of claim 1, further comprising creating hydraulic pressure to clear an obstruction in the clogged drain line.

8. The method of claim 7, wherein the hydraulic pressure is diverted to flow the liquid counter-current into an outlet of the drain line.

9. The method of claim 7, wherein flow of condensate from an exterior open-end outlet of the drain line is controlled, and the liquid is allowed to flow into the exterior open-end of the drain line.

10. The method of claim 8, further comprising detecting lack of condensate flow in or downstream of an outflow section of a three-way valve.

* * * * *